US007281636B2

(12) United States Patent
Kim et al.

(10) Patent No.: US 7,281,636 B2
(45) **Date of Patent: *Oct. 16, 2007**

(54) BOTTLE CAP HAVING TEAR TAB AND SEALING BEAD

(75) Inventors: Sungsuk Steve Kim, Batavia, IL (US); Daniel Luch, Morgan Hill, CA (US)

(73) Assignee: Portola Packaging, Inc., Batavia, IL (US)

( * ) Notice: Subject to any disclaimer, the term of this patent is extended or adjusted under 35 U.S.C. 154(b) by 437 days.

This patent is subject to a terminal disclaimer.

(21) Appl. No.: 10/742,416

(22) Filed: Dec. 19, 2003

(65) Prior Publication Data

US 2004/0173563 A1 Sep. 9, 2004

Related U.S. Application Data

(63) Continuation-in-part of application No. 09/893,181, filed on Jun. 26, 2001, now Pat. No. 6,681,947.

(51) Int. Cl.
*B65D 41/32* (2006.01)
*B65D 53/00* (2006.01)

(52) U.S. Cl. ..... 215/254; 215/253; 215/341; 220/266; 220/270

(58) Field of Classification Search ..... 220/270; 215/254

See application file for complete search history.

(56) References Cited

U.S. PATENT DOCUMENTS 3,163,308 A 12/1964 Friedell
3,392,862 A 7/1968 Faulstich
3,684,124 A * 8/1972 Song ..... 220/270
3,840,137 A 10/1974 Faulstich
3,974,932 A 8/1976 Faulstich
3,979,002 A 9/1976 Faulstich
4,106,653 A 8/1978 Martinelli
4,256,233 A 3/1981 Harding
4,564,117 A 1/1986 Herbert
4,577,771 A 3/1986 Martinez
4,884,707 A 12/1989 Crisci (Continued)

FOREIGN PATENT DOCUMENTS

EP 0025991 A1 4/1981

(Continued)

*Primary Examiner*—Robin A. Hylton
(74) *Attorney, Agent, or Firm*—James P. Hanrath; Adam K. Sacharoff

(57) ABSTRACT

A bottle cap includes a top and a skirt depending from the top, the skirt having a bottom edge, a locking bead radially extending inward from an interior of the skirt intermediate the top and the bottom edge, a tear tab extending downward from the bottom edge, a first tear line proximate the tear tab and extending upward along the skirt from the bottom edge across the locking bead and terminating at a terminus adjacent to or below the perimeter. The first tear line is substantially parallel to a longitudinal axis of the cap. The first tear line and the longitudinal axis define a radially extending plane P. The bottle cap also includes a second tear line proximate the tear tab and spaced from the first tear line. An upper portion of the second tear line extending through the plane P and between the terminus and the longitudinal axis. A method of using the bottle cap is also disclosed.

18 Claims, 13 Drawing Sheets

U.S. PATENT DOCUMENTS

| | | | | |
|---|---|---|---|---|
| 4,911,316 | A | | 3/1990 | Tackles |
| 5,224,616 | A | | 7/1993 | Crisci |
| 5,232,125 | A | | 8/1993 | Adams |
| 5,284,265 | A | | 2/1994 | Crisci |
| 5,370,270 | A | | 12/1994 | Adams et al. |
| 5,513,763 | A | | 5/1996 | Adams et al. |
| 5,603,422 | A | * | 2/1997 | Herrmann ..... 215/256 |
| 5,662,231 | A | | 9/1997 | Adams et al. |
| 5,687,865 | A | | 11/1997 | Adams et al. |
| 5,868,281 | A | | 2/1999 | Bietzer et al. |
| 5,909,827 | A | | 6/1999 | Bietzer et al. |
| 5,975,320 | A | | 11/1999 | Bietzer et al. |
| 6,082,567 | A | | 7/2000 | Bietzer et al. |
| 6,102,226 | A | | 8/2000 | Verderber |
| 6,177,041 | B1 | | 1/2001 | Bietzer |
| 6,237,790 | B1 | | 5/2001 | Verderber |
| 6,283,331 | B1 | | 9/2001 | Lucas |
| 6,338,414 | B1 | | 1/2002 | Schellenbach |
| 6,681,947 | B2 | * | 1/2004 | Kim et al. ..... 215/254 |

FOREIGN PATENT DOCUMENTS

| | | | |
|---|---|---|---|
| WO | WO 82/03612 | A | 10/1982 |

* cited by examiner

BOTTLE CAP HAVING TEAR TAB AND SEALING BEAD

CROSS-REFERENCES TO RELATED APPLICATIONS

This application is a Continuation-in-Part of U.S. patent application Ser. No. 09/893,181 filed Jun. 26, 2001, now U.S. Pat. No. 6,681,947, entitled Bottle Cap Having Tear Tab and Sealing Bead, the entire contents of which is incorporated herein by this reference.

BACKGROUND OF THE INVENTION

1. Field of the Invention

This invention relates to a new and improved bottle cap. More particularly, the present invention is directed to a bottle cap having an improved sealing bead configured to engage a container crown proximal the maximum diameter thereof. The present invention is also directed to a bottle cap having an improved tear tab including a line of weakness extending along a skirt upward from a bottom edge of the bottle cap and onto a top of the bottle cap. The present invention is also directed to a bottle cap having a liner retainer.

2. Description of Related Art

An exemplar of a known cap for use with large water containers of the type used with water dispensers and water coolers is U.S. Pat. No. 5,232,125 to Adams. The cap disclosed by the Adams '125 patent includes a top, a cylindrical side wall extending downward from the top, a rounded corner interconnecting the top and the cylindrical side walls, and a tension ring configured to fit under the neck bead, that is a crown of a container neck. The cap disclosed by the Adams '125 patent also includes internal upper and lower seal beads on the inside of the wall of the corner which are configured to tightly engage the container lip and seal against leakage.

The large water containers used with such known caps are generally blow molded and include neck finishes that are trimmed or otherwise finished using conventional methods. Although the neck finishes are somewhat standardized within the container industry, the actual heights of container neck crowns tend to vary to some degree due to the trimming and other finishing processes. In the event that excessive material is removed from a container neck crown during trimming, the upper and lower seal beads of known caps of the type disclosed by the Adams '125 patent might not effectively seal against the crown.

Caps of the type disclosed by the Adams '125 patent generally include a score line having a curved portion which extends from the base of the cap skirt to a horizontal portion. Although such score lines are effective for removing the cap from a container, a substantially vertical score line is beneficial for manufacturing purposes because caps molded with vertical score lines are generally easier to uniformly fill with molten resin and easier to remove from a mold. Due to the substantial skirt height of such caps, a single vertical score line of the type generally used on shorter caps, such as those disclosed by U.S. Pat. No. 6,082,567 to Bietzer et al., is generally insufficient to remove a cap from a large water container. Instead, a pair of vertical tear lines is needed to facilitate removal of the cap from a container.

An exemplar of a cap having a pair of vertical tear lines is U.S. Pat. No. 6,102,226 to Verderber which shows a bottle cap having a top, a skirt, a tab, and vertical tear lines which extend from the tear tab and terminate on an upper portion of the skirt below the top. The Verderber patent also discloses a bottle cap having a top, a skirt, a tab, and a single vertical tear line which extends downward from a circumferentially extending, horizontal internal tear line. The Verderber patent discloses yet another bottle cap including a top, a skirt, a tab, and a single vertical tear line which extends around the top at the intersection of a bevel and the top.

U.S. Pat. No. 6,177,041 to Bietzer shows another cap having a top, a skirt, a tear tab, and vertical tear lines which extend from the tear tab and terminate on an upper portion of the skirt. One of the tear lines disclosed by Bietzer extends close to the top while the other tear line terminates at a location somewhat below the top.

U.S. Pat. No. 5,909,827 to Bietzer et al. shows a cap having a top, a skirt, and vertical score lines which extend from the tear tab. One score line extends up to an upper slanted portion of the skirt. The other score line extends from up the bottom of the skirt to the top.

Although conventional wisdom might imply that extending both tear lines to the top of a cap would be beneficial for removing the cap from a container, the prior art shows at least one tear line of a cap generally terminating at a location somewhat below the top in order to facilitate removal of the cap from the bottle. As described in the Bietzer '041 patent, it was found that pulling on the tab of caps having a pair of tear lines which extend to the top thereof actually caused a locking ring thereof to increase its grip on a bottle used therewith thus making the cap very hard to remove. In particular, pulling the tab of such caps causes a reduction in the effective diameter of the locking ring disadvantageously tightening the locking ring around the bottle. Thus, a user frequently needed to grip the skirt of such caps and pry them from the bottle.

Furthermore, removal of known caps generally does not completely fracture and/or destroy all sealing means of the caps. Accordingly, users of known caps may be inclined to misuse the caps by reusing the caps on a reusable bottle. Storage of potentially dangerous substances is a major concern in the field of reusable bottles.

One aspect of many closures for bulk water containers is that they include a form of liner to increase the integrity of the seal. One common form of liner comprises a plastic, highly compressible foam. Because they are highly compressible, these liners are able to accommodate a wide range of bottle dimensions and common bottle finish defects. These plastic foam liners are most often cut as a disk or annular "donut" from a sheet of material and then inserted or punched into the closure or bottle cap. The disk or "donut" is cut to a diameter larger than an inside diameter of the closure locking bead of the cap and this diametrical interference suffices to retain the liner in the cap during transport and application to the container or bottle without having to resort to more expensive retention processing such as hot melt gluing.

A characteristic of the plastic foam liner systems is that the only retention mechanism holding the liner within the cap is the above-mentioned diametrical interference between the liner and the closure locking bead of the cap. In this case, a certain amount of liner shifting can occur for various reasons. Firstly, during mechanical cutting and insertion processes, the liner might not be inserted perfectly axially with respect to the cap. Secondly, during application of the closure to a container neck, a certain amount of cap distortion and/or cocking, that is tilting or slanting, with respect to the container neck may occur. In other words, a first portion of the perimeter of the closure may seat on the container neck prior to another portion circumferentially removed from the first portion. This "cocking" action can "pull" the liner in the direction of the first portion thus shifting the liner with respect to the container and the closure. Finally, the forces involved in the vertical application of the closure to a plastic container generally cause some axial compression of the plastic container, resulting in escape of some of the air in the headspace above the liquid within the container. The flow of this air outward through the neck of the container can cause the liner to shift with respect to both the container and the closure.

In the past, the diameter of the liners used has been sufficient to accommodate the above described shifting while still ensuring that the liner contacts the crown sealing surface of a conventional blown-finish container around its full circumference. More recently, however, alternate manufacturing techniques have emerged which make it desirable to increase the internal diameter of the container neck bore. Specifically, crown finishes of the container neck formed by injection molding or compression molding place a premium on increasing the internal diameter of the bore in order to save material and reduce manufacturing cycles. In addition, increased bore diameters decrease the possibility of damaging the top finish of the container neck from incidental contact with fill tubes of container filling equipment.

Disadvantageously, increasing the bore diameter of a container neck decreases the top "land" area of the crown finish. A cross-sectional comparison of the land areas for a conventional blown finish versus the more recent injected or compression finishes is shown in FIGS. 13 and 14. In FIGS. 13 and 14, the "land" surface or area of the two different types of finishes are indicated by $L_1$ and $L_2$, respectively.

It has now been observed that the above described liner shifting may be sufficient to cause the liner to miss the reduced land area $L_2$ presented by bottles having increased bore size, as shown in FIG. 14, resulting in inadequate sealing and leakage.

What is needed is a cap which overcomes the above and other disadvantages of known caps.

BRIEF SUMMARY OF THE INVENTION

An object of the present invention is to provide an improved bottle cap which allows a user to remove the bottle cap from a container in a facile manner.

Another object of the present invention is to provide an improved bottle cap which allows only a single use thereof, thus preventing misuse of a reusable bottle.

Another object of the present invention is to provide an improved bottle cap having additional structure to minimize and/or prevent excessive shifting of a liner with respect to the bottle cap and the container to which it is applied when the bottle cap is applied to the container.

An object of the present invention is to provide an improved bottle cap to minimize and/or prevent excessive liner shifting without the need for costly retention processes such as hot melt gluing.

In summary, one aspect of the present invention is directed to a bottle cap including a top, a skirt, a locking bead, a tear tab, and a line of weakness. The top has a perimeter. The skirt depends from the perimeter and has a bottom edge. The locking bead radially extends inward from the skirt intermediate the top and the bottom edge. The tear tab extends downward from the bottom edge. The line of weakness extends along the skirt upward from the bottom edge and onto the top.

The skirt may include a frustoconical upper portion and a cylindrical lower portion in which the line of weakness extends from the bottom edge, though the cylindrical lower portion, through the frustoconical upper portion and onto the top.

The cap may include a second line of weakness extending along the skirt upward from the bottom edge, through the cylindrical lower portion and terminating in the frustoconical upper portion.

Another aspect of the present invention is directed to a bottle cap including a top, a skirt, a locking bead, a tear tab, a line of weakness, and a gusset. The top has a perimeter. The skirt depends from the perimeter and has a bottom edge. The locking bead radially extends inward from the skirt intermediate the top and the bottom edge. The tear tab extends downward from the bottom edge. The first line of weakness extends along the skirt upward from the bottom edge. The gusset extends from the locking bead into the skirt. The gusset may extend along a portion of the line of weakness.

The cap may include a second line of weakness and a second gusset, the second line of weakness extending along the skirt upward from the bottom edge terminating adjacent the perimeter, and the second gusset extending from the locking bead into the skirt, the second gusset extending along a portion of the second line of weakness.

Another aspect of the present invention is directed to a bottle cap including a top having a perimeter, a skirt depending downward from the perimeter, the skirt having a bottom edge, a locking bead radially extending inward from an interior surface of the skirt intermediate the top and the bottom edge, a tear tab extending downward from the bottom edge, a first line of weakness proximate the tear tab and extending upward from the bottom edge and across the locking bead, and reinforcing structure including a first gusset extending from the locking bead into the skirt and along a portion of the first line of weakness to provide leverage for tearing through the locking bead.

Another aspect of the present invention is directed to a bottle cap including a top having a perimeter, a skirt depending downward from the perimeter, the skirt having a bottom edge, a locking bead radially extending inward from an interior surface of the skirt intermediate the top and the bottom edge, and a sealing bead radially extending inward from an interior surface of the skirt approximately midway between the top and the locking bead. The cap may include a tear tab extending downward from the bottom edge, a first line of weakness proximate the tear tab and extending upward from the bottom edge and across the locking bead.

Another aspect of the present invention is directed to a bottle cap including a top having a perimeter, a skirt depending downward from the perimeter, the skirt having a bottom edge, a tear tab extending downward from the bottom edge, first and second lines of weakness proximate the tear tab and extending upward along the skirt from the bottom edge defining a tear tab portion between the lines of weakness, and gripping structure for facilitating gripping of the tear tab portion by a user as the tear tab portion is torn away from the skirt, the ribbing located on the tear tab portion intermediate the bottom edge and the top. The gripping structure may include ribs. The ribs may be located on an internal surface of the skirt.

Another aspect of the present invention is directed to a bottle cap including a top, a skirt and a liner retaining protrusion. The top has a perimeter and an inside surface. The skirt depends downwardly from the perimeter. The liner retaining protrusion depends downwardly from the inside surface of the top and is adapted to prevent shifting of a liner with respect to the cap. The top, skirt and liner retaining protrusion may be monolithically formed. The liner retaining protrusion may be conical. The liner retaining protrusion may also be spike-shaped. Alternatively, the liner retaining protrusion may include a cylindrical wall which depends downwardly from the inside surface of the top. The liner retaining protrusion may include an outwardly extending bead extending from a lower portion of the cylindrical wall.

Yet another aspect of the present invention is directed to a closure including a cap and a liner. The cap includes a top having a perimeter and an inside surface, a skirt depending downward from the perimeter, and a liner retaining protrusion depending downwardly from the inside surface of the top. The liner is positioned adjacent the inside surface of the cap within the skirt. The liner retaining protrusion extends into the liner to retain the liner and prevent the liner from axially shifting with respect to the cap. The liner retaining protrusion may extend into and through the liner. Alternatively, the liner retaining protrusion may extend through the liner such that an intermediate portion extends axially through the liner and an end portion extends below the liner, the end portion extending at an angle with respect to the intermediate portion.

The bottle cap having tear tab and sealing bead of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Figure 2:
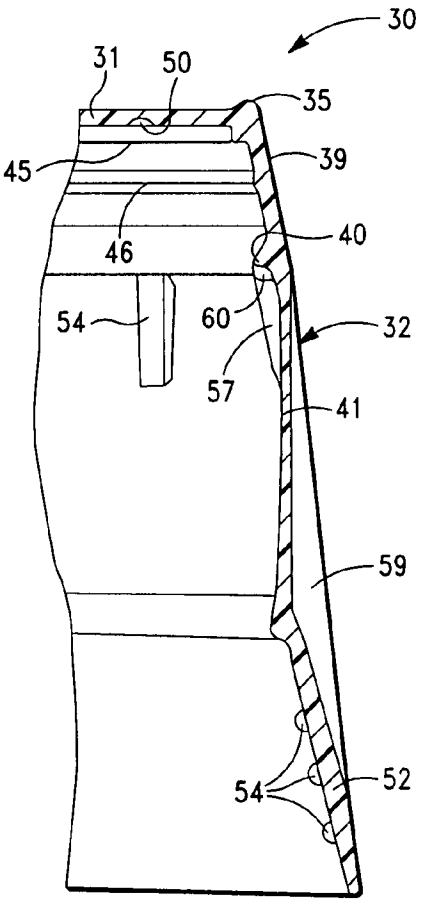
FIG. 2 is a sectional view of the cap shown in FIG. 1 taken substantially along line 2-2 of FIG. 1.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Turning now to the drawings, wherein like components are designated by like reference numerals throughout the various figures, attention is directed to FIGS. 1-4. A bottle cap 30 in accordance with the present invention is intended for use with large water bottles, for example, five gallon bottles of the type that are inverted and placed in a water dispenser. It will be understood, however, that the invention may be used with caps of other design. The bottle cap is formed of plastic or other suitable materials. Preferably, low density polyethylene is used in the construction of the bottle cap in accordance with the present invention, however, one should appreciate that other suitable materials can be used. The material of the bottle cap, together with the generally thin-walled construction of the cap, generally provide for a bottle cap which tightly conforms to a container neck crown Cap 30 has a top 31 and a skirt 32 which depends from a periphery 35 of cap 30. In the illustrated embodiment, periphery 35 forms a label positioning bead within which a label or other indicia may be applied to the cap. Skirt 32 extends downwardly terminating in a bottom edge 36.

An upper portion 39 of skirt 32 is frustaconically shaped having an inward-upward slant. The upper slanted portion is relatively thin-walled and is not as rigid as conventional caps such as the ones disclosed by U.S. Pat. No. 5,232,125 to Adams, the entire content of which is incorporated herein by this reference. The thin-walled configuration allows the cap to conform to the crown finish 42 of a bottle neck 43 as it is applied to the neck. The ability of upper skirt portion 39 to conform with crown 42 also increases the performance of liners, such as the foam disk disclosed in U.S. Pat. No. 5,687,865 to Adams, the entire content of which is incorporated herein by this reference. In particular, as upper skirt 39 conforms with the shape of neck crown 42, the contact surface area between the liner and the neck crown increases significantly.

Figure 4:
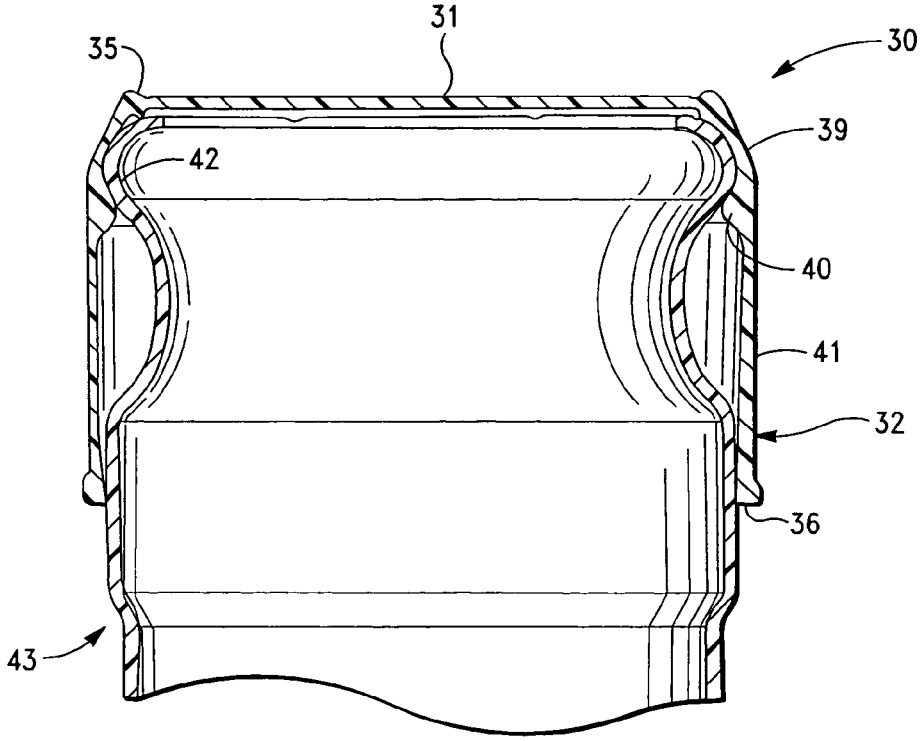
FIG. 4 is a sectional view of the cap shown in FIG. 1 taken substantially along line 4-4 of FIG. 1 positioned on a neck of a container.

One should appreciate that the upper portion of the skirt need not be slanted but may instead be cylindrical. On an interior of skirt 32 is an upper locking bead 40, which is located approximately at the intersection of slanted upper portion 39 and a cylindrical lower portion 41 of the skirt. Locking bead 40 fits snugly below upper crown portion 42 conventionally formed on the finish of a five gallon water bottle neck 43 as shown in FIG. 4.

Optionally, a non-ovality bead 44 may be provided in the form of an outwardly and/or inwardly extending projection formed on the exterior adjacent bottom edge 36 of skirt 32 in order to preserve the round shape of skirt 32 and also to rigidify lower edge 36. In the form of the invention shown in FIGS. 1-4, there is an internal top seal bead 45 adjacent the intersection of top 31 and slanted skirt portion 39 which engages bottle neck crown 42 to inhibit leakage. An additional internal seal bead 46 is located on the interior of slanted portion 39 intermediate top 31 and locking bead 40. As noted above, the thin-walled configuration of the upper slanted portion 39 allows cap 30 to conform to the crown finish 42 of a bottle neck 43 as it is applied to the neck. This configuration increases the effectiveness of side seal bead 46. One should appreciate that a cap can be provided with either a top seal bead or an internal seal bead, or both a top seal bead and an internal seal bead in accordance with the present invention.

In one embodiment of the present invention, seal bead 46 radially extends inwardly from an inner surface of slanted upper skirt portion 39 intermediate a bottom surface of top 31 and locking bead 40. Seal bead 46 has a minimum inside diameter which is slightly less than a corresponding outside diameter of crown 42 of neck 43. Preferably, seal bead 46 is located approximately midway between the bottom surface of top 31 and locking bead 40, as is discussed in greater detail below.

A pair of spaced lines of weakness or tear lines 48, 49 extend upwardly from bottom edge 36. Tear line 48 extends upwardly from bottom edge 36, along skirt 32 and onto top 31 while tear line 49 terminates approximately at the top of skirt 32 adjacent periphery 35 of top 31. As shown, tear lines 48 and 49 extend on the exterior of skirt 32, and tear line 48 continues on the interior of top 31. One should appreciate that other configurations may be used. For example, it is possible to form a portion of the lines of weakness on the exterior of the top. Such a configuration would advantageously prevent any possibility of misalignment between line of weakness portions on the exterior of the skirt and top because, in the event that standing steel is used to form the lines of weakness, the standing steel used to form both portions of the line of weakness would be located in the mold cavity.

It is likewise possible to form a portion of the lines of weakness on an interior portion of the skirt. In the event that a line of weakness is located on the interior of the skirt, the line of weakness should not violate the sealing bead of the cap in order to provide an effective fluid seal.

As noted above, a portion of tear line 48 continues onto top 31 and has a curved portion 50 which extends radially inward along top 31 to an arcuate portion and terminates adjacent to periphery 35 of top 31. In the embodiment shown in FIGS. 1-4, tear line 48 extends along top 31 from a first point $P_1$ adjacent periphery 35 along curved portion 50 to a second point $P_2$ adjacent periphery 35 and circumferentially spaced from the first point $P_1$. In this embodiment, first point $P_1$ and second point $P_2$ are circumferentially spaced apart in the range of approximately 45° to 90°.

One should appreciate, however, that first point $P_1$ and second point $P_2$ need only to be spaced apart a distance that is large enough to allow a sufficient portion of locking bead 40 to bend away from crown 42 thus allowing removal of cap 30 from bottle 43 in a facile manner as discussed below. For example, first point $P_1$ may be spaced from second point $P_2$ by approximately 20°, and are preferably spaced apart at least approximately 30-45°.

On the other hand, tear line 49 does not continue onto top 31 in this embodiment. Instead, a stop 51 is provided on top 31 adjacent periphery 35 to prevent splitting action along tear line 49 from continuing onto top 31. Stop 51 is provided in the form of a thickened member projecting upwardly from top 31 adjacent periphery 35. Stop 51 terminates tearing along line 49. One should appreciate that other forms of stop can be used in accordance with the present invention. For example, additional material may be provided adjacent the upper terminus of tear line 49 in order to prevent splitting action along tear line 49 from propagating onto top 31. One should appreciate that the stop can also be positioned slightly below the top on the slanted skirt portion, and/or positioned adjacent the locking bead in accordance with the present invention. One should also appreciate that line of weakness may also terminate at the locking bead in which case, the locking bead may serve as the stop.

A tab 52 extends downwardly from bottom edge 36 of skirt 32 between tear lines 48 and 49. Pulling tab 52 upward causes skirt 32 to split along tear lines 48 and 49 forming a tear tab portion 53 which includes a portion of skirt 32 between tear lines 48 and 49. The upward pulling of tab 52 and tearing of tear tab portion 53 from the remainder of the skirt, in effect, interrupts the continuity of locking bead 40 and enables the cap 30 to be pulled off the bottle neck with relative ease. The function of tab 52 and tear tab portion 53 is that when gripped by a consumer and pulled upward and/or outward it causes skirt 32 to tear along tear lines 48 and 49 so that the function of bead 40 in retaining the cap on the bottle neck is overcome. Continued pulling of tab 52 removes cap 30 from bottle neck 43. To facilitate the consumer gripping tab 52, a plurality of ribs 54 spaced upwardly from the bottom end of tab 52 are formed on the back surface of tab 52. One should appreciate one or more ribs may be provided for this purpose on either one or both of the external and internal surfaces of tear tab 52.

Another aspect of the present invention is concerned with structure provided on the interior of skirt 32 adjacent the intersection of tear lines 48 and 49 with upper locking bead 40. Circumferentially spaced reinforcing gussets 56 are provided which extend from a bottom portion of locking bead 40 downwardly at an angle into an adjacent portion of cylindrical lower portion 41 of skirt 32. Such gussets not only provide structural integrity to locking bead 40 but also assist in applying cap 30 to neck 43. In particular, the gussets also serve as a ramp against crown 42 for facilitating bead 40 in passing over crown 42 upon application of cap 30 to neck 43.

Additionally, tear line gussets 57 also extend from a bottom portion of locking bead 40 downwardly at an angle into an adjacent portion of cylindrical lower portion 41 of skirt 32 and are positioned immediately adjacent tear lines 48 and 49. Tear line gussets 57 increase leverage of tear tab portion 53 to facilitate tearing through locking bead 40 as a consumer pulls tab 52 upwardly to split skirt 32 along lines of weakness 48 and 49. In particular, tear line gussets 57, in effect, form a pry bar which provides the leverage necessary to tear through locking bead 40 and also prevents tear tab portion 53 from bending excessively as tear tab 52 is pulled upwardly by the consumer.

Tear line gussets 57 may also minimize and/or eliminate the possibility of tab 52 breaking off from cap 30 as a user pulls upwardly on tab 52 and failing to split tear lines 49 and 48 through locking bead 40. An additional tear tab gusset 58 can be provided between tear line gussets 57 to further reinforce the connection between tear tab 52 and locking bead 40.

The illustrated gussets 56, 57 and 58 are substantially triangular shaped flat members extending from locking bead 40 into lower portion 41 of skirt 32. One should appreciate that the gussets may have a variety of shapes, and other types of reinforcing structure can be used. For example, the gussets may be arcuate shaped, sweeping from the locking bead into the lower portion of the skirt.

Figure 1:
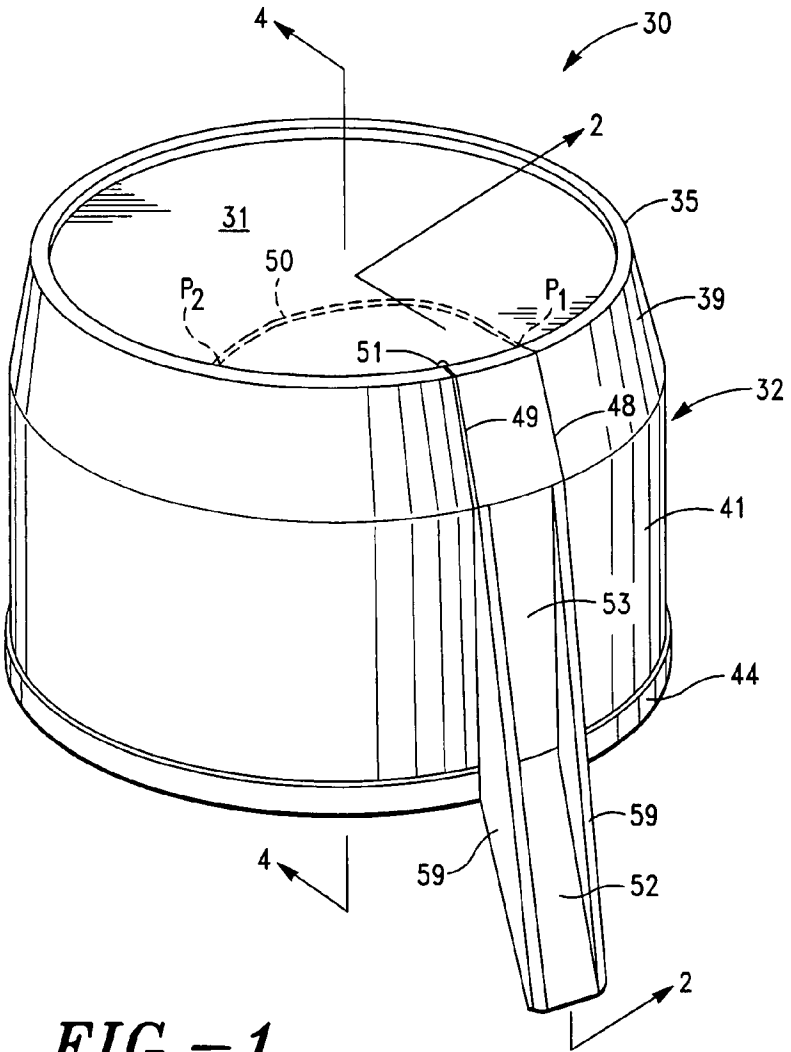
FIG. 1 is a top perspective view of a bottle cap in accordance with the present invention.

As shown in FIG. 2, tear line gussets 57 overlap external tear tab ribs 59 which are provided on either side of tear tab 52, as shown in FIGS. 1 and 2. Tear tab ribs 59 extend substantially vertically along lines of weakness 48 and 49. This configuration provides substantially continuous reinforcing structure along the tear tab which provides structural integrity to the tear tab. In particular, such reinforcing structure directs the tear along lines of weakness 48 and 49 and minimizes the possibility of tearing action to propagate away from lines 48 and 49. Furthermore, such continuous reinforcing structure increases leverage applied by a user to tear tab 52 and tear tab portion 53 thereby facilitating tearing through the continuous portion of locking bead 40. One should appreciate, however, that other types of substantially continuous reinforcing structure can be utilized in accordance with the present invention. For example, internal and/or external tear tab ribs which extend into the locking bead can be used. Alternatively, the tear tab may include a continuous thickened portion which is thicker relative to the skirt. Such a continuous thickened portion can extend from the lower edge of the skirt to the locking bead, to the upper angled portion of the skirt, and/or to the top.

Figure 3:
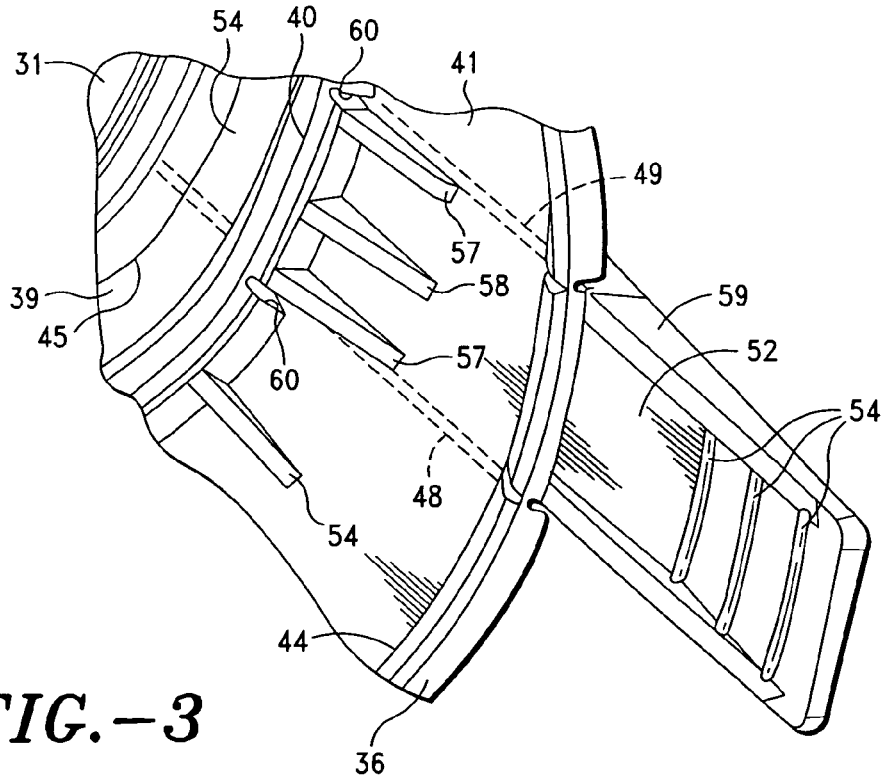
FIG. 3 is an enlarged detailed view of an interior portion of the cap shown in FIG. 1.

A notch 60 is also provided in a bottom portion of locking bead 40 opposite and in line with each line weakness 48 and 49, as shown in FIGS. 2 and 3. Notch 60 facilitates tearing action along the lines of weakness through the locking bead without violating locking bead 40, that is, compromising the portion of the locking bead which engages a container. Although notch 60 is shown on an internal surface of the cap, one should appreciate that other variations can be utilized within the scope of the present invention. For example, a notch can be provided on an external surface of the skirt overlying the bottom portion of the locking bead such that the notch facilitates tearing action along the lines of weakness without violating the locking bead.

In use, when cap 30 is applied to neck 43, it seats on the bottle neck and cannot be removed from the bottle so long as the tear lines 48 and 49 are intact. To open the bottle, a consumer grips tab 52. The outward slanting of tab 52 away from bottle neck 43 facilitates gripping tab 52 whereby transverse ribs 54 improve the user's grip on the tab. The user then pulls vertically upwardly/outwardly on tab 52 and thus causes tearing along tear lines 48 and 49 whereby tab 52 rolls back upon itself. Advantageously, the vertical motion is equally suited for use by both right-handed and left-handed users. The rolling of the tab 52 allows energy transformation into tear energy, thus making tearing of the tear lines 48 and 49 easier for the consumer. Tear line gussets 57 control the bending stiffness of tear tab portion 53 along the length of skirt 32 adjacent locking bead 40. This transforms pull force energy into tear strain energy, reducing the force required to tear the skirt along tear lines 48 and 49 and through locking bead 40.

As the user continues to pull tab 52 in substantially the same motion, cap 30 continues to split along tear lines 48 and 49 to the top of upper inclined portion 39. At this point, splitting action along tear line 48 continues onto top 31. However, stop 51 prevents the splitting action along tear line 49 from propagating onto top 31.

As the user yet continues to pull tab 52 in substantially the same motion, cap 30 continues to split along tear line 48, specifically through first point $P_1$ and along curved portion 50 thereby splitting top 31. As a result of this motion, the user simultaneously pulls a portion of locking bead 40 away from crown 42 of bottle 43. As the splitting action along curved portion 50 of tear line 49 nears second point $P_2$, a sufficient portion of locking bead 40 is pulled away from crown 42 which allows the user to remove cap 30 from bottle 43 in a facile manner. In particular, the user need not additionally grasp lower portion 41 of skirt 32 and pry the cap away from the bottle, although this alternate process of removal has been judged acceptable.

Because locking bead 40 is substantially destroyed upon removal by a consumer, cap 30 may only be used once. This configuration is advantageous when used in combination with returnable bottles because such configuration prevents misuse of the returnable bottle. For example, since the locking bead is inoperable once a user tears the tear tab portion through the locking bead, a user cannot reuse the cap to reseal the container. Advantageously, this configuration discourages misuse of returnable bottles and, in particular, discourages the reuse of returnable bottles to store possibly harmful and dangerous substances.

Many features of the present invention provide for a bottle cap which is lightweight. For example, the gussets allow for thinner walls of the skirt and top. The lighter weight advantageously results in less distortion of caps located in the bottom of shipping boxes due to settling during shipping and handling. Furthermore, the light-weight design provides for a less-expensive and environmentally-friendly cap because less material is used to manufacture the cap.

Advantageously, the structural walls of the cap of the present invention are more uniform in design, a feature which reduces environmental stress cracking. Since the bottle caps used to seal large water bottles generally are always under stress when seated on a container neck of a bottle. Environmental stress cracking may be caused by great variations in thickness of a low density polyethylene closure under stress. Such environmental stress cracking often results from excessive wall thickness. The bottle cap of the present invention is of a thin-walled design which avoids excessive wall thicknesses found in prior caps. Accordingly, the thin-walled design of the bottle cap of the present invention minimizes and/or prevents environmental stress cracking commonly found in prior caps.

Figure 6:
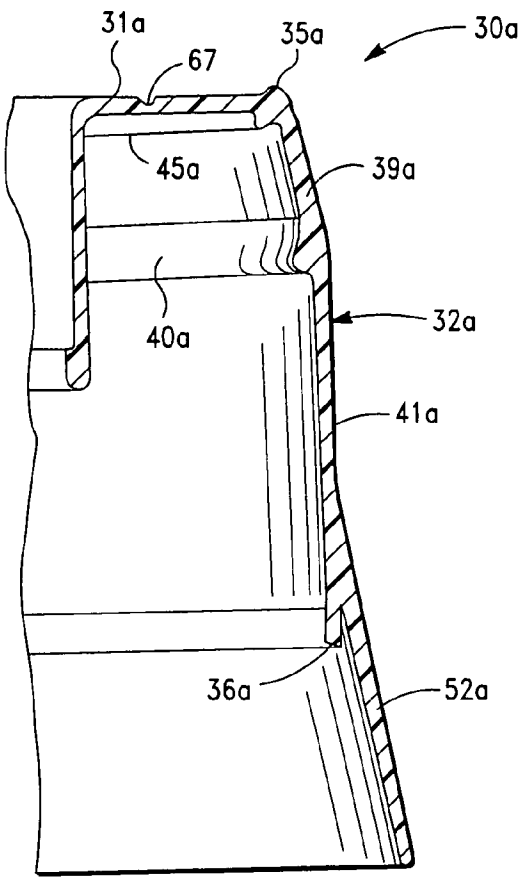
FIG. 6 is a sectional view of the cap shown in FIG. 5 taken substantially along line 6-6 of FIG. 5.
Figure 5:
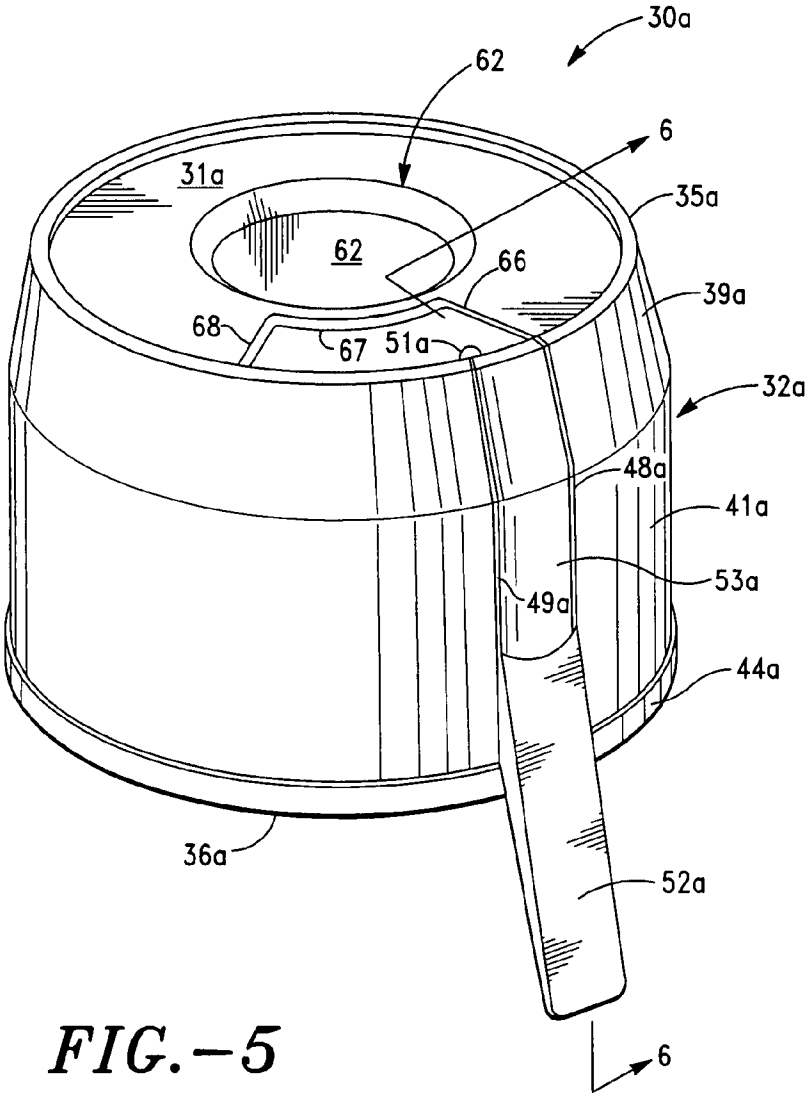
FIG. 5 is a top perspective view of a modified bottle cap similar to that shown in FIG. 1 including a non-spill well in accordance with the present invention.

Turning now to FIGS. 5 and 6, a cap 30*a* is of the "non-spill variety". In many respects, the structure of cap 30*a* resembles that of cap 30 discussed above. Cap 30*a* includes a central vertical well 62. An internal bead 63 is formed at the bottom of well 62. The purpose and function of well 62 will be understood by reference to U.S. Pat. No. 5,370,270 to Adams et al., the entire contents of which is incorporated herein by this reference.

Cap 30*a* also includes tear lines 48*a* and 49*a* similar to those discussed above. The portion of tear line 49*a* which extends along top 31*a*, however, includes linear portions as well as a curved portion. In particular, tear line 48*a* includes a first straight portion 66, which extends radially inward from a first point adjacent periphery 35*a*, an arcuate portion 67, and a second linear portion which extends radially outward and terminates at a second point adjacent periphery 35*a* spaced from the first point. As illustrated, portions 66, 67 and 68 are formed on an exterior surface of cap 30*a* in this embodiment.

One should appreciate that the portion of tear line 48*a* which extends along the top can have a wide variety of configurations. For example, the top portion of the tear line can include an intermediate linear portion interconnecting first and second linear portions 66 and 68 instead of arcuate portion 67. Such a straight portion can be substantially tangential to well 62 or can be spaced outwardly from well 62. Furthermore, a single linear portion, or chord portion, can be used instead of portions 66, 67 and 68.

The use and operation of removing cap 30*a* from a bottle is similar to that of cap 30 discussed above. In particular, a user may grip tab 52*a* and pull the tab to split cap 30*a* along tear lines 48*a* and 49*a*, bend locking bead 40*a* away from a bottle, and remove cap 30*a* from the bottle, all in a facile manner.

Figure 7:
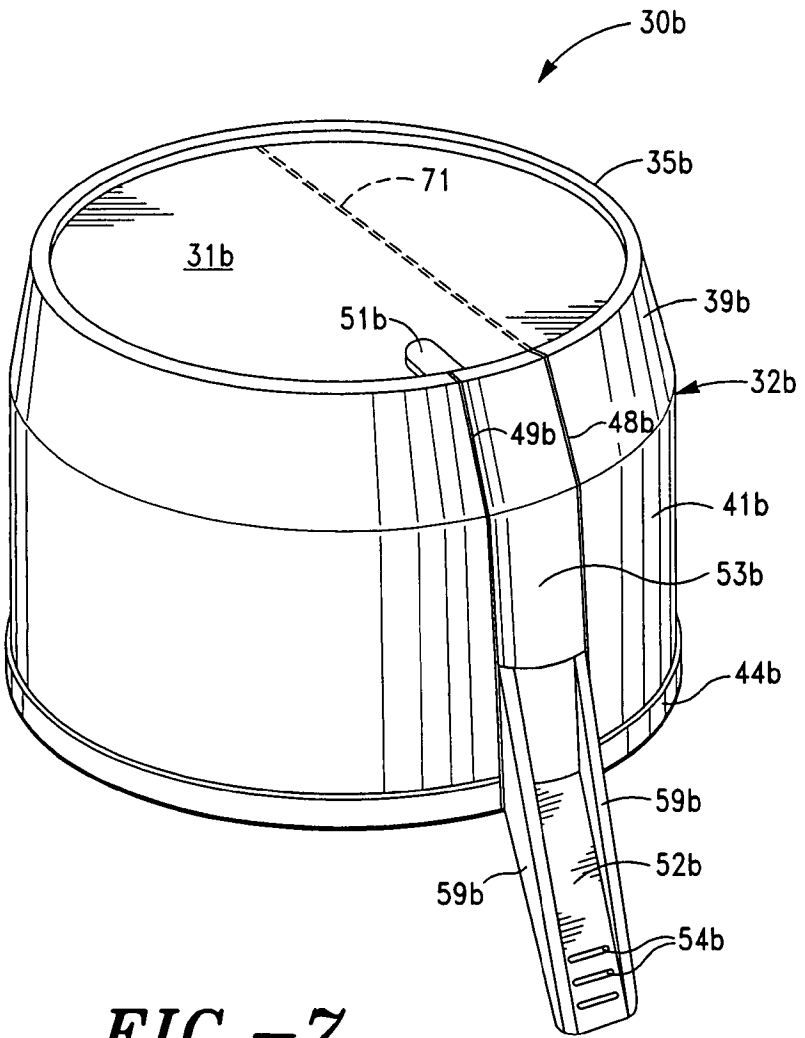
FIG. 7 is a top perspective view of a modified bottle cap similar to that shown in FIG. 1 in accordance with the present invention.
Figure 8:
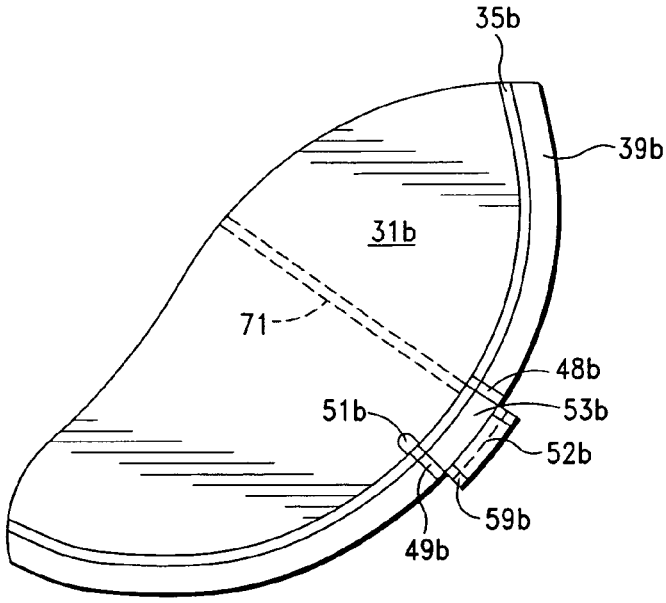
FIG. 8 is a top plan view of a portion of the cap shown in FIG. 7.

In one embodiment of the present invention, shown in FIGS. 7 and 8, a cap 30*b* has a top 31*b*, here shown as a substantially flat disc, and having a peripheral depending skirt 32*b*. Skirt 32*b* includes an outward-downward slanted upper skirt portion 39*b*. Below upper skirt portion 39*b* is a substantially cylindrical lower skirt portion 41*b*. On the interior of lower skirt portion 41*b* is an internal locking bead 40*b* which engages under a bead on the exterior of a container neck. Cap 31*b* includes a locking bead which extends around the circumference of lower skirt portion in the same manner as locking bead 40 described above.

Lines of weakness or tear lines 48*b* and 49*b* extend upwardly along skirt 32*b*. A pull tab 52*b* extends downwardly from lower skirt portion 41*b* between tear lines 48*b* and 49*b*. Tear line 48*b* extends upwardly and onto top 31*b* and includes a straight portion 71 which extends across top 31*b*. Tear line 49*b* terminates adjacent the periphery of top 31*b*. A stop 51*b* is provided to prevent splitting action along tear line 49*b* from propagating onto top 31*b*. Stop 51*b* is provided in the form of additional material which forms a thickened portion of top 31*b* adjacent the upper terminus of tear line 49*b*.

As shown in FIG. 8, straight portion 71 is slightly offset from tear line 48*b* toward stop 51*b* in accordance with the present invention. In particular, straight portion 71 is offset slightly to the left as viewed in FIG. 8. Such configuration minimizes and/or prevents any tendency of splitting action along tear line 48*b* to propagate away from straight portion 71. For example, offsetting straight portion 71 slightly to the left minimizes or prevents splitting action along tear line 48*b* from propagating to the right (as shown in FIG. 8) along peripheral bead 35*b*. Furthermore, the offset configuration may be advantageous from an alignment standpoint. As the alignment tolerances between a mold core and a mold cavity used to manufacture cap 30 may vary, the mold can be configured such that any variation in alignment will result in an offset to the left, varying only in degree as to how much it is offset to the left.

In use and operation, removing cap 30*b* from a bottle is similar to that of the above caps. In particular, a user may grip tab 52*b* and pull the tab to split cap 30*b* along tear lines 48*b* and 49*b*, bend locking bead 40*b* away from a bottle, and remove cap 30*b* from the bottle, all in a facile manner.

Figure 9:
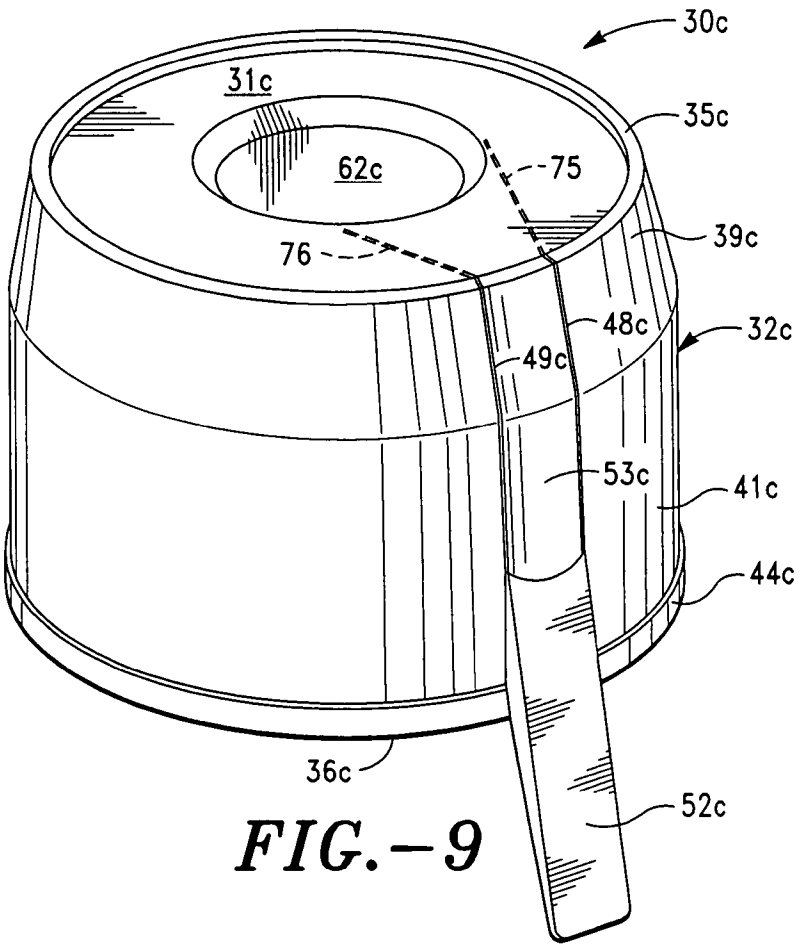
FIG. 9 is a top perspective view of a modified bottle cap similar to that shown in FIG. 5 including a non-spill well in accordance with the present invention.

In one embodiment of the present invention, shown in FIG. 9, a cap 30*c* has a top 31*c* having a non-spill well 62*c* and a peripheral depending skirt 32*c*. Skirt 32*c* includes an outward-downward slanted upper skirt portion 39*c*. Below upper skirt portion 39*c* is a substantially cylindrical lower skirt portion 41*c*. On the interior of lower skirt portion 41*c* is an internal locking bead 40*c* which engages under a bead on the exterior of a container neck. Cap 30*c* includes a locking bead which extends around the circumference of the lower skirt portion in the same manner as locking bead 40 described above.

Lines of weakness or tear lines 48*c* and 49*c* extend upwardly along skirt 32*c*. A pull tab 52*c* extends downwardly from lower skirt portion 41*c* between tear lines 48*c* and 49*c*. Tear line 48*c* extends upwardly along skirt 32*c* and onto top 31*c* and includes a straight portion 75 which extends radially inward from perimeter 35*c* across a portion of top 31*c* and diverges outwardly from well 62*c*. Tear line 49*c* similarly extends upwardly and onto top 31*c* and includes a straight portion 76 which extends radially inward from perimeter 35*c* and diverges outwardly from well away from straight portion 75.

In use and operation, removing cap 30*c* from a bottle is similar to that of the above caps. In particular, a user may grip tab 52*c* and pull the tab to split cap 30*c* along tear lines 48*c* and 49*c*, bend locking bead 40*c* away from a bottle, and remove cap 30*c* from the bottle, all in a facile manner.

Figure 12:
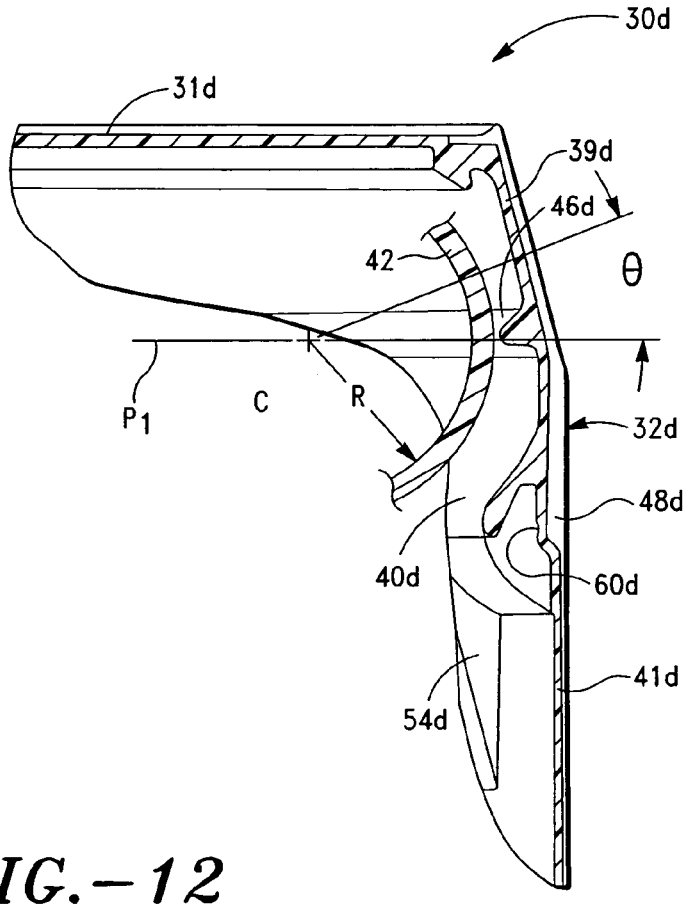
FIG. 12 is a sectional view of a portion of the cap shown in FIG. 10 taken substantially along line 12-12 of FIG. 10 schematically showing the height of a seal bead relative to a container neck crown in accordance with the present invention.
Figure 10:
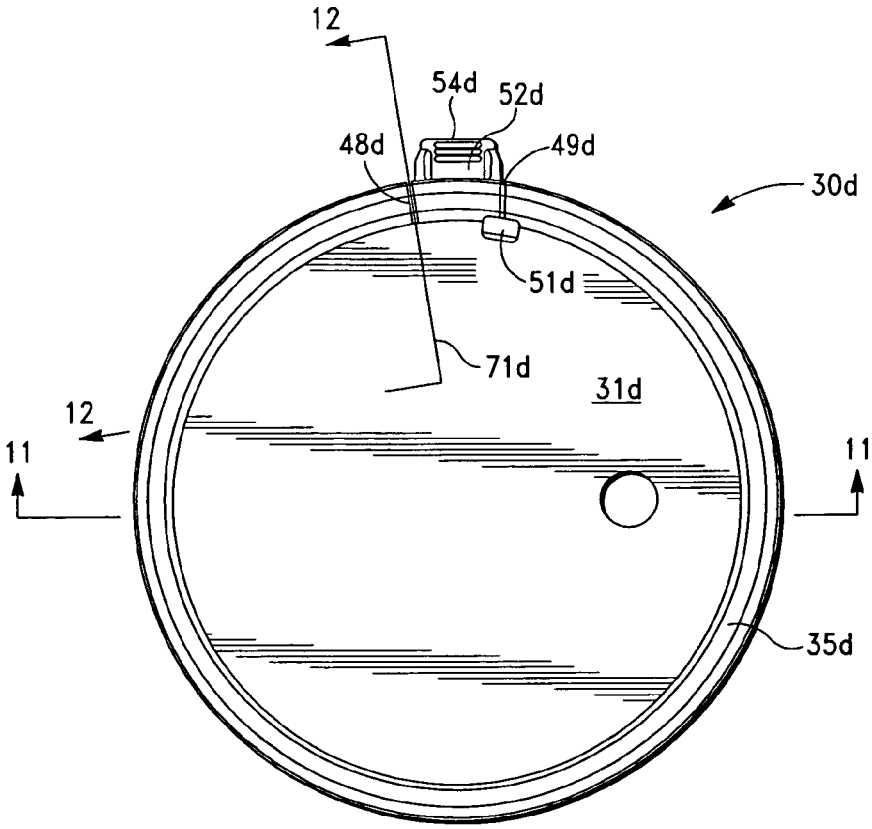
FIG. 10 is a top plan view of a modified cap similar to that shown in FIG. 1 in accordance with the present invention.
Figure 11:
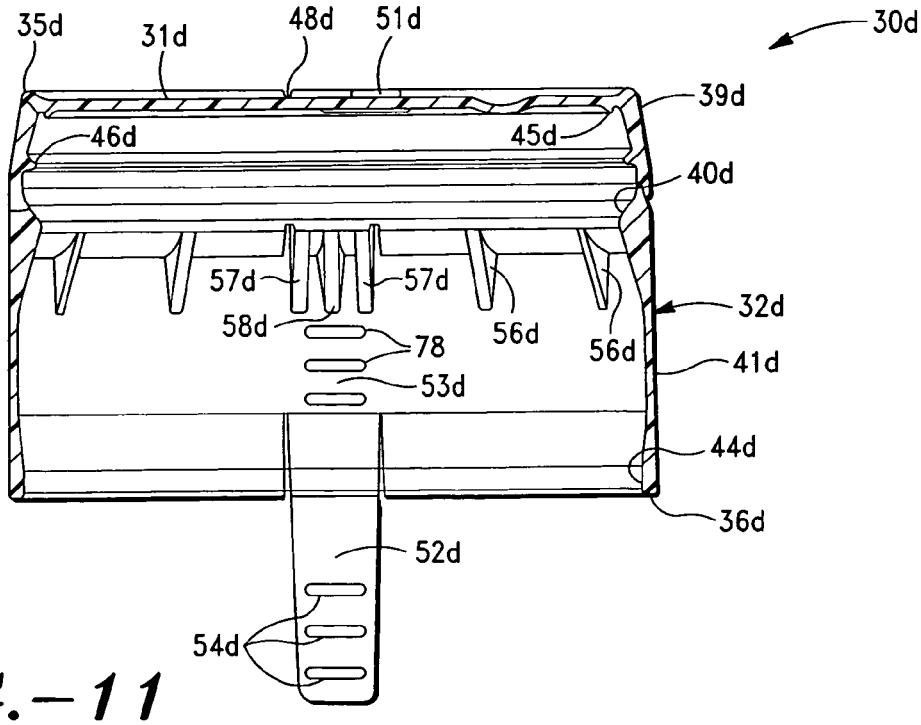
FIG. 11 is a sectional view of the cap shown in FIG. 10 taken substantially along line 11-11 of FIG. 10.

In one embodiment of the present invention, shown in FIGS. 10-12, a cap 30*d* has a top 31*d* and a peripherally depending skirt 32*d*. Skirt 32*d* includes an outward-downward slanted upper skirt portion 39*d*. Below upper skirt portion 39*d* is a substantially cylindrical lower skirt portion 41*d*. On the interior of lower skirt portion 41*d* is an internal locking bead 40*d* which engages under a bead on the exterior of a container neck. As shown, locking bead 40*d* extends around the circumference of lower skirt portion 41*d*.

Lines of weakness or tear lines 48*d* and 49*d* extend upwardly along skirt 32*d*. A pull tab 52*d* extends downwardly from lower skirt portion 41*d* between tear lines 48*d* and 49*d*. Tear line 48*d* extends upwardly and onto top 31*d* and includes a straight portion 71*d* which extends across top 31*d*. Tear line 49*d* terminates adjacent the periphery of top 31*d*. A rectangular stop 51*d* is provided to prevent splitting action along tear line 49*d* from propagating onto top 31*d*. Stop 51*d* is provided in the form of additional material which forms a thickened portion of top 31*d* adjacent the upper terminus of tear line 49*d*.

As shown in FIG. 10, tear lines 48*c* and 49*c* extend through an upper portion of periphery 35*d* to facilitate tearing action along the tear lines and through the additional material of periphery 35*d*.

Also shown in FIG. 11, internal ribbing 78 is provided on an internal surface of tear tab portion 53*d* for facilitating gripping of tear tab portion 53*d* by a user as it is pulled away from the remainder of skirt 32*d*. Ribbing 78 is located on tear tab portion 53*d* intermediate bottom edge 36*d* and top 31*d*, and more particularly between bottom edge 36*d* and locking bead 40*d*. The ribbing illustrated in FIG. 11 includes horizontally extending ribs 78 on an internal surface of skirt

32*d*, however, one should appreciate that other forms of ribbing can be utilized in accordance with the present invention. For example, circular protrusions can be provided instead of, or in addition to, the illustrated horizontal ribs. One should also appreciate that such ribbing can be provided on either an internal or an external surface of the skirt provided the shape facilitates gripping by a user.

Also shown in FIG. 11, seal bead 46*d* radially extends inwardly from an inner surface of slanted upper skirt portion 39*d* intermediate a bottom surface of top 31*d* and locking bead 40*d*. Seal bead 46*d* has a minimum inside diameter which is slightly less than a corresponding outside diameter of crown 42 of neck 43 (not shown in FIG. 11), which diameter is generally standardized within the industry. Preferably, seal bead 46*d* is located approximately midway between the bottom surface of top 31*d* and locking bead 40*d*. In such configuration, the minimum inside diameter of seal bead 46*d* is slightly less than the maximum outside diameter of crown 42 and is thus adapted to sealingly engage crown 42 when the cap is applied to the container. As seal bead 46*d* is located approximately midway between the top and locking bead, seal bead 46*d* will engage crown 42 proximate the maximum diameter of crown 42 thus providing an improved fluid seal, in part, because sealing forces of seal bead 46*d* upon crown 46*d* extend in a substantially radial direction.

Because seal bead 46*d* is located approximately midway between the bottom surface of top 31*d*, locking bead 40*d* extends substantially along an imaginary plane P which extends through the maximum outer diameter of crown 42, as is schematically shown in FIG. 12. One should appreciate that the position of cap 30*d* relative to crown 42 shown in FIG. 12 is schematic in nature, and that thin-walled cap 30*d* is actually dimensioned to stretch over crown 42 in such a manner that top seal bead 45*d*, lower seal bead 46*d* and locking bead 40*d* would each contact and compress against a respective portion of crown 42. In particular, the inside diameters of top seal bead 45*d*, lower seal bead 46*d* and locking bead 40*d* are all less than the maximum outside diameter of crown 42. Accordingly, upon application by pushing cap 30*d* on container neck 43, upper portion 39*d* and lower portion 41*d* of skirt 32*d* stretch a sufficient amount to allow locking bead 40*d* to pass over crown 42. The resulting tension in the walls of upper portion 39*d* and lower portion 41*d* cause each of upper seal bead 45*d* lower seal bead 46*d* and locking bead 40*d* to compress against respective portion of crown 42.

As shown in FIG. 12, crown 42 has a radius of curvature R wherein plane P passes through the center C of the radius of curvature. Preferably, seal bead 46*d* extends toward and sealingly engages crown 42 within an angle$\theta$ of plane P. Angle $\theta$ is no greater than approximately 30°, preferably in the range of 0° to 10°, and most preferably in the range of 0° to 5°. Such configuration allows an effective fluid seal despite minor variations in the height of the crown common due to trimming of the container neck and other methods of finishing the neck.

Also shown in FIG. 12, locking bead 40*d* includes notch 60*d* for facilitating tearing action along a line of weakness through the locking bead. In this embodiment, notch 60*d* extends into a bottom surface of locking bead 40*d* upwardly past the minimum inside diameter of the locking bead and under an upper surface of the locking bead. Such configuration allows the removal of a substantial amount of material from the locking bead along the lines of weakness without violating the upper surface of the locking bead. The upper surface of the locking bead may or may not be used as a secondary or supplemental fluid sealing surface, that is supplemental to one or both of seal beads 45*d* and 46*d*. In the event that the upper surface is utilized as a sealing surface, notch 60*d* advantageously does not violate the upper surface and thus does not affect the ability of the upper surface to serve as a supplemental fluid seal.

In use and operation, removing cap 30*d* from a bottle is similar to that of the above caps. In particular, a user may grip tab 52*d* and pull the tab to split cap 30*d* along tear lines 48*d* and 49*d*, bend locking bead 40*d* away from a bottle, and remove cap 30*d* from the bottle, all in a facile manner. In the event a user releases tab 52*d* and attempts to grip tear tab portion 53*d* as the user attempts to tear through locking bead 40*d*, ribbing 78 provides a gripping surface which the user can firmly grip and continuing tearing to remove cap 30*d* from a bottle.

Figure 13:
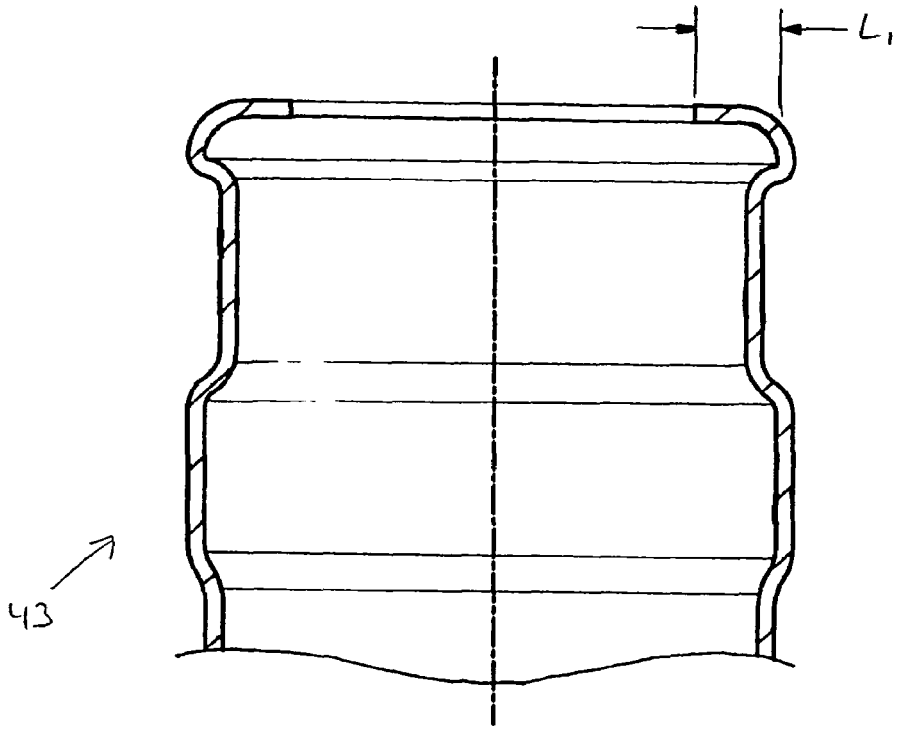
FIG. 13 is a schematic cross-sectional view of a container neck having a conventional blown finish.
Figure 14:
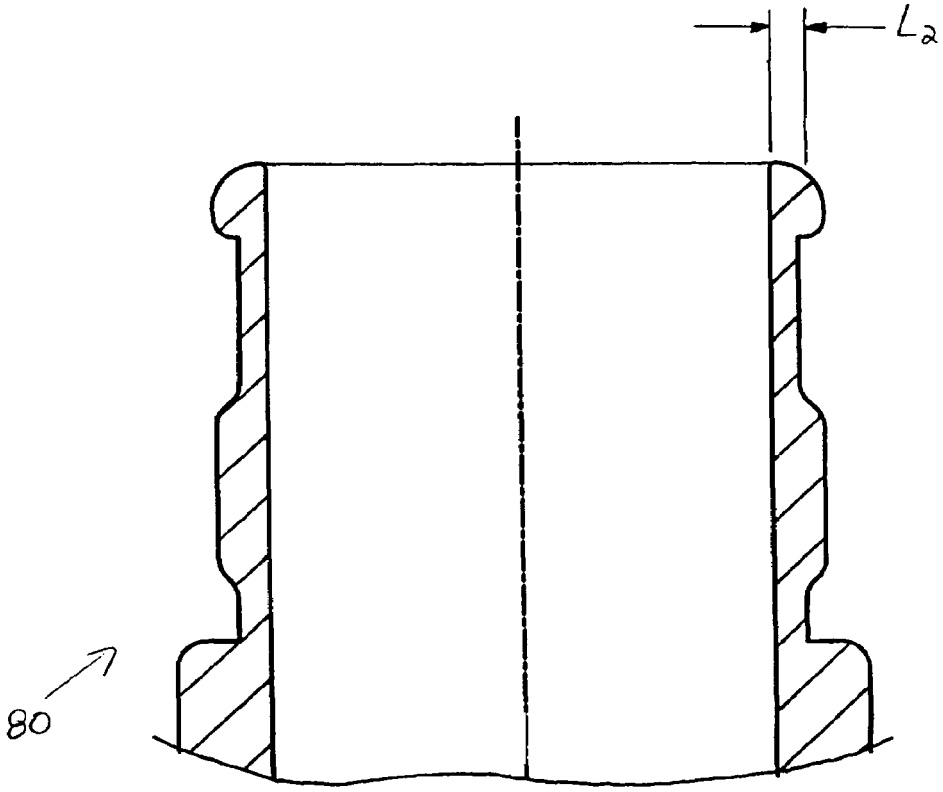
FIG. 14 is a schematic cross-sectional view of another container neck having a injected or compression finish.

As noted above, increasing the bore diameter of a container neck disadvantageously decreases the top "land" area of the crown finish. A cross-sectional comparison of the land areas for a conventional blown finish of container neck 43 versus the more recent injected or compression finishes of container neck 80 is shown in FIGS. 13 and 14. In FIGS. 13 and 14, the "land" surface or area of the two different types of finishes are indicated by $L_1$ and $L_2$, respectively.

In one embodiment of the present invention, in which cap 30*e* is used in combination with a liner, for example, a foam liner 83, cap 30*e* includes a liner retainer in the form of three liner retaining protrusions 84 which extend downwardly from an inside surface of top 31*e*, as shown in FIGS. 15-19. Liner retaining protrusions 84 prevent liner 83 from shifting and missing the land area, and in particular, the reduced land area $L_2$ presented by bottles having an increased bore size container neck 80, as shown in FIG. 14, and thus prevent inadequate sealing and minimize or prevent leakage.

In many respects, the structure of cap 30*e* resembles that of caps 30 and 30*a-d* discussed above. Cap 30*e* includes a top 31*e* having a perimeter 34*e* and a skirt 32*e* depending downward from perimeter 35*e*. Cap 30*e* further includes tear lines 48*e* and 49*e* similar to those discussed above. A curved portion 50*e* of tear line 49*e* extends along a bottom surface of top 31*e*. Curved portion 50*e* extends radially inward from a first point adjacent periphery 35*e* along an arcuate path which also extends radially outward and terminates at a second point adjacent periphery 35*e* spaced from the first point. In this embodiment, in contrast to prior embodiments, stop 51*e* has a semicircular shape.

Figure 15:
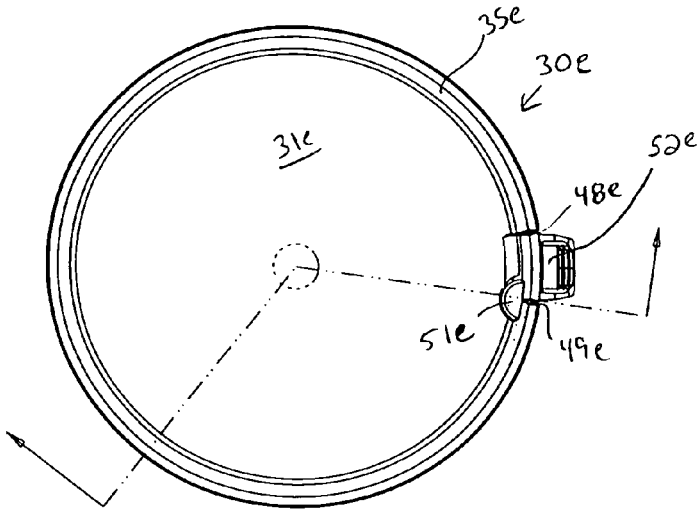
FIG. 15 is a top plan view of a modified cap in accordance with the present invention similar to that shown in FIG. 1 in accordance with the present invention.
Figure 16:
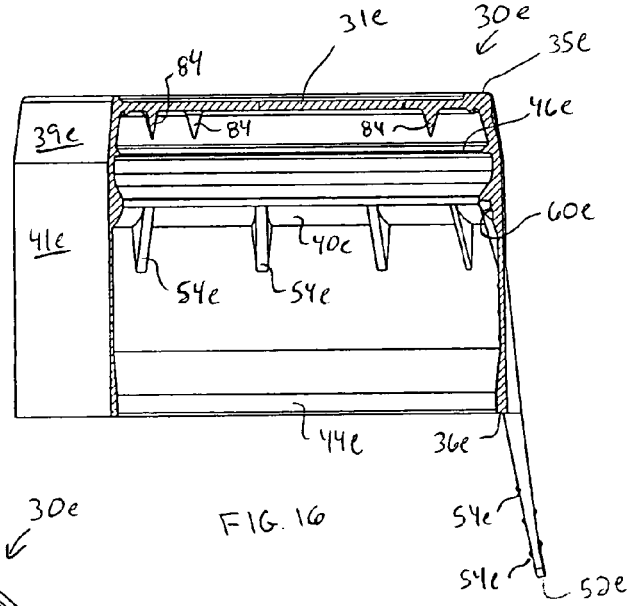
FIG. 16 is a sectional view of the cap shown in FIG. 16 taken substantially along line 16-16 of FIG. 15.
Figure 17:
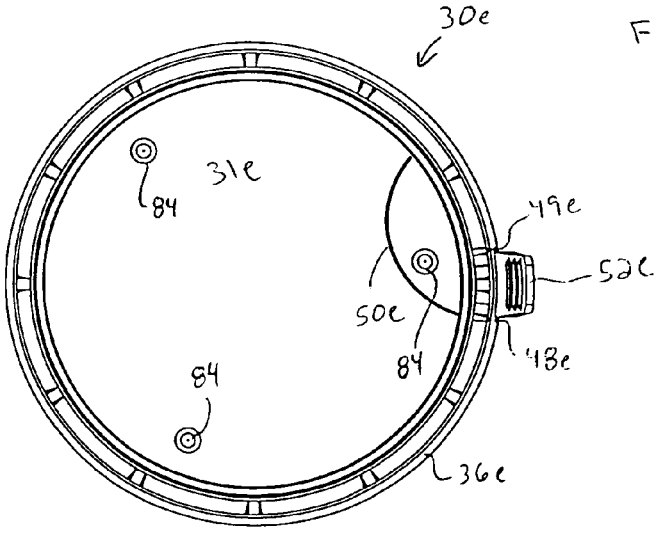
FIG. 17 is a bottom plan view of the cap of FIG. 15.

As illustrated in FIGS. 15-17, each liner retaining protrusion 84 is in the form of a spike which extends downward from an inside surface of top 31*e*. One should appreciate, however, that the actual shape and configuration of the liner retaining protrusion is subject to considerable variation. For example, the ends of each liner retaining protrusion may include a barb or a spur to promote retention of or even engagement with a liner.

Although the illustrated embodiment includes three liner retaining protrusions 84, one should appreciate that the actual number is subject to considerable variation depending on closure and bottle finish design. For example, one should appreciate that one or more liner retaining protrusions can be utilized in accordance with the present invention.

Figure 18:
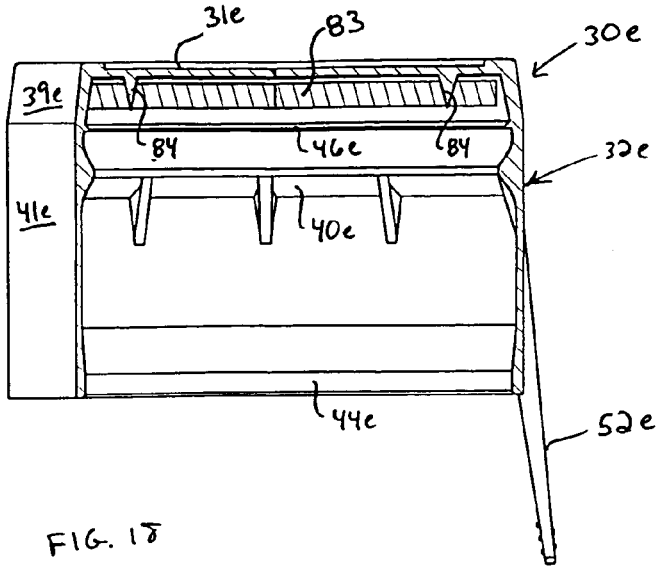
FIG. 18 is a sectional view showing the cap of FIG. 16 in combination with a liner.
Figure 19:
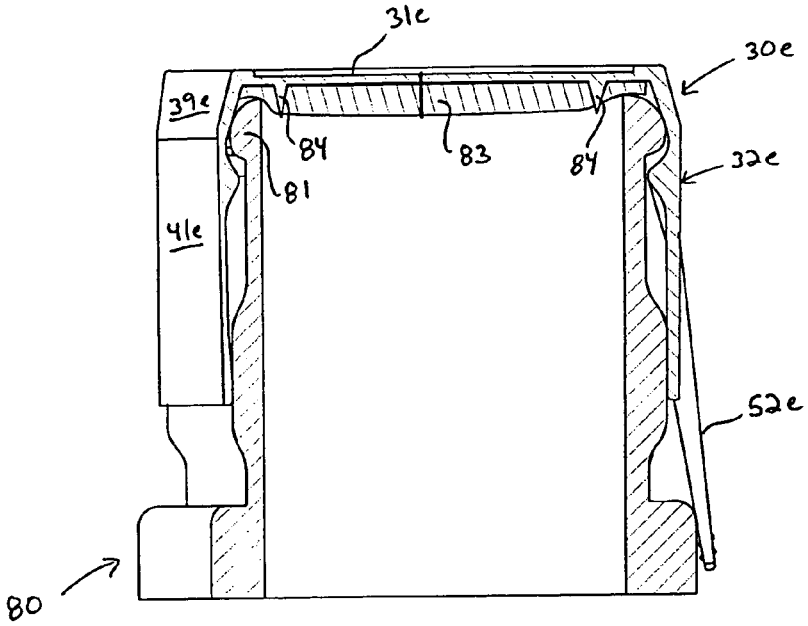
FIG. 19 is a sectional view showing the cap of FIG. 16 and the liner of FIG. 18 in combination with the container neck of FIG. 15.

Turning now to FIG. 18, the height of liner retention protrusion 84 is approximately the same as the thickness of the intended liner, that is, approximately the same as liner 83, as shown in FIGS. 18 and 19. Normally, this height will be from approximately 0.050 inch to about 0.25 inch. When a liner is punched into, or otherwise applied to a closure, the liner retaining protrusions penetrate the foam liner and anchor it in position with respect to the closure. For example, as liner 83 is applied to cap 30*e*, spikes 84 penetrate foam liner 83 and anchor liner 83 in position with respect to cap 30*e*, as shown in FIG. 18, thereby increasing foam retention and greatly reducing any tendency of the liner to shift from its axial positioning.

As schematically shown in FIG. 19, foam liner 83 compresses between crown 81 and the inside surface of top 31*e* as cap 30*e* is applied to container neck 80. As liner retaining protrusions 84 prevent liner 83 from shifting as cap 30*e* is applied to container neck 80, liner 83 sufficiently contacts reduced land area $L_2$ to ensure adequate sealing and to minimize and/or prevent leakage.

The use and operation of removing cap 30*e* from a bottle is similar to that of caps 30 and 30*a-d* discussed above. In particular, a user may grip tab 52*e* and pull the tab to split cap 30*e* along tear lines 48*e* and 49*e*, bend locking bead 40*e* away from a bottle, and remove cap 30*e* from the bottle, all in a facile manner. Advantageously, liner retaining protrusions 84 may also serve to better retain liner 83 against the internal surface of top 31*e* even as cap 30*e* is removed from container neck 80.

Figure 20:
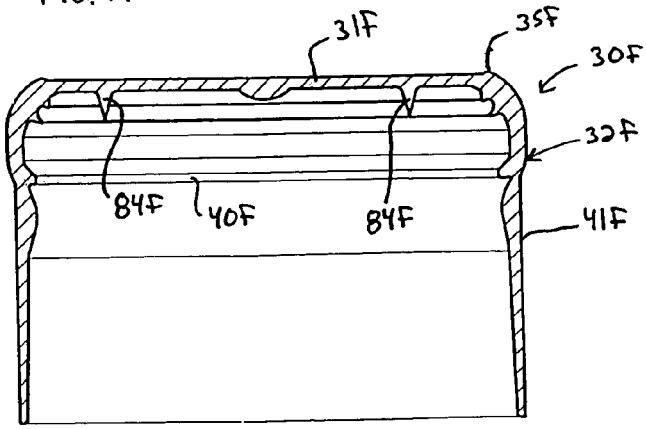
FIG. 20 is a sectional view of a modified cap in accordance with the present invention similar to that shown in FIG. 15.

One should appreciate that liner retaining protrusions can be utilized with all of the previously disclosed embodiments in accordance with the present invention whenever a liner is used. One should further appreciate that liner retaining protrusions can also be used on a variety of other closures in accordance with the present invention. For example, FIG. 20 discloses a cap 30*f* which has a general configuration which is similar to the closure disclosed by the Adams '125 patent. In particular, cap 30*f* includes a top 31*f* having a perimeter 35*f* and a skirt 32*f* depending downward from perimeter 34*f*. As illustrated in FIG. 20, liner retention projections 84*f* are also provided to prevent a liner from shifting in the same manner as discussed above.

Figure 21:
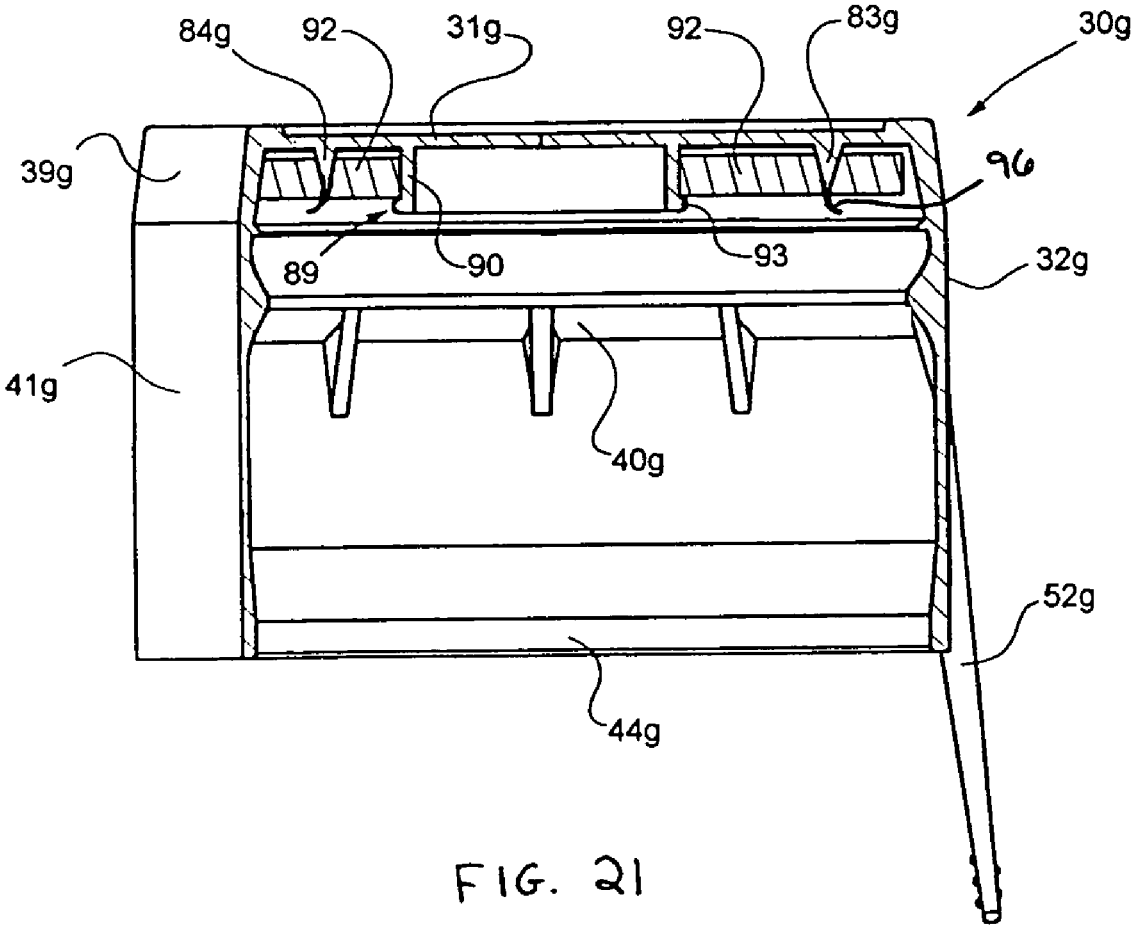
FIG. 21 is a sectional view, similar to FIG. 16, illustrating a modified cap and liner in accordance with the present invention.

In one embodiment shown in FIG. 21, cap 30*g* includes a liner retention protrusion in the form of a short hollow protrusion in the form of a cylindrical projection 89 which extends downwardly from an inside surface of top 31*g*, as shown in FIG. 21. Cap 30*g* is particularly suited for use with donut-shaped liners of the type commonly used with non-spill caps, such as the one disclosed by the Adams '125 patent. In particular, cylindrical projection 89 prevents a donut-shaped liner 92 from shifting and missing the reduced land area $L_2$ presented by bottles having an increased bore size container neck 80, as shown in FIG. 14, thereby promoting adequate sealing. Preferably, cylindrical projection 89 includes a substantially vertical wall 90 having an outside diameter approximately the same that of the conventional non-spill wells disclosed by the Adams '125 patent. However, the height of cylindrical projection 89 is substantially shorter than the height of a conventional non-spill well. For example, the height of cylindrical projection is approximately one-eighth to three-eighths of an inch. One should appreciate, however, that wall 91 need not be vertical and may instead have a slightly frustoconical shape.

As illustrated in the embodiment shown in FIG. 21, cylindrical projection 89 includes a radially outwardly extending bead 93. Bead 93 extends radially outwardly from a bottom portion of cylindrical projection 89 and serves to better retain liner 92 on cap 30*g* in that it provides additional interference between liner 92 and cap 30*g*. The use and operation of removing cap 30*g* from a bottle is similar to that of caps 30 and 30*a-f* discussed above.

Although the embodiment illustrated in FIG. 21 discloses cylindrical projection 89 in combination with spikes 83*g*, one should appreciate that cylindrical projection 89 can be utilized alone, without spikes 83*g*, in accordance with the present invention to retain the liner within the cap.

One should also appreciate that, in the event that spikes are used, either alone or in combination with a cylindrical projection or other liner retainer, the spikes may be dimensioned such that the tips thereof are bent as a plastic foam liner is inserted or punched into the closure or bottle cap. In particular, as shown in FIG. 21, the height of spikes 83*g* is substantially greater than the thickness of liner 92. Each end 96 of spikes 83*g* are bent by the tooling which is used to mechanically insert liner 92 into cap 30*g*. In particular, as liner 92 is inserted into cap 30*g*, spikes 83*g* pierce one side of foam liner 92 and extend through liner 92. As spikes 83*g* extend out the other side of foam liner 92, ends 96 contact the insertion tooling and are bent to one side, thus providing a hooked structure to further retain liner 92 within cap 30*g*.

Figure 22:
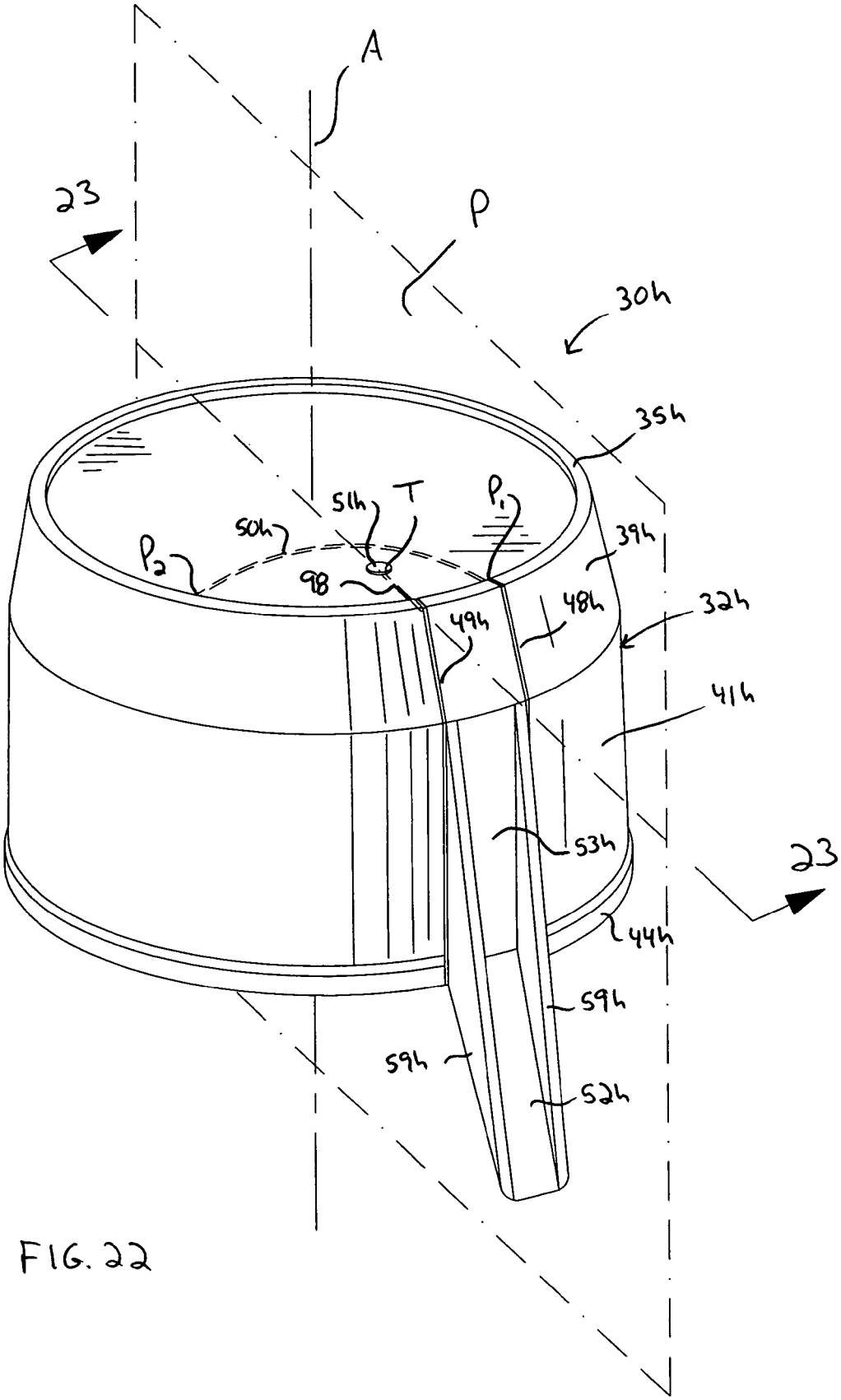
FIG. 22 is a top perspective view of a modified bottle cap similar to that shown in FIG. 1 in accordance with the present invention.
Figure 23:
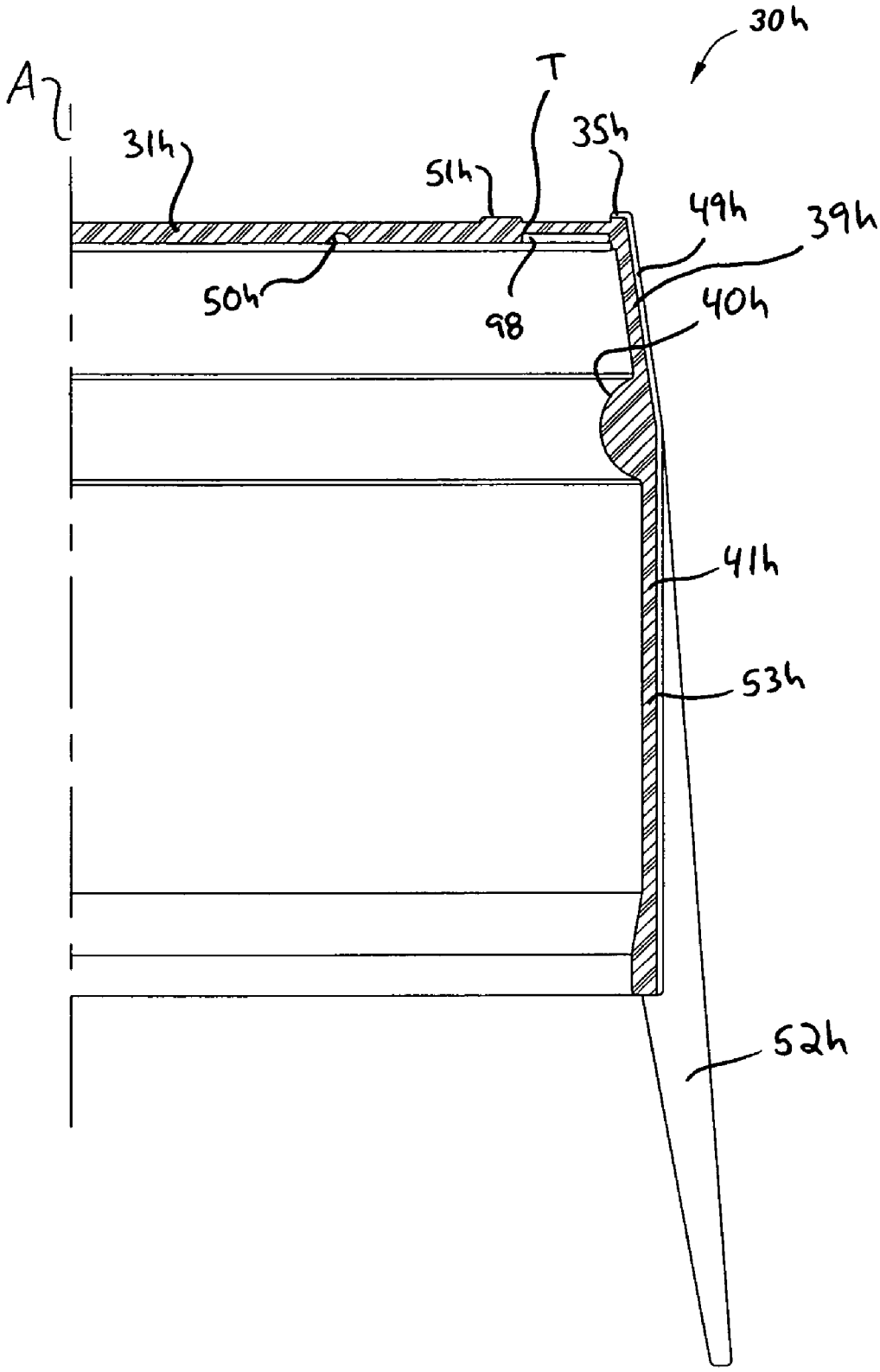
FIG. 23 is a sectional view of the cap shown in FIG. 22 taken substantially along line 23-23 of FIG. 22.

In one embodiment of the present invention shown in FIGS. 22 and 23, cap 30*h* is substantially similar to cap 30 described above except that stop 51*h* is located on top 31*h* and set radially inward from periphery 35*h*. In this embodiment, tear line 49*h* also extends upwardly and onto top 31*h* and includes a straight portion 98 that extends along top 31*h* and terminates at stop 51*h*. Stop 51*h* is provided to prevent splitting action along tear line 49*b* from propagating further toward the center of top 31*h* and intersecting with curved portion 50*h* of tear line 48*h*, and thus prevents complete removal of tab 52*h* from cap 30*h* when a user is removing cap 30*h* from a bottle. Stop 51*h* is provided in the form of additional material which forms a thickened disk on top 31*h*, however, one will appreciate stop 51*h* may have other suitable shapes and configurations.

In use and operation, removing cap 30*h* from a bottle is similar to that of the above caps. In particular, a user may grip tab 52*h* and pull the tab to split cap 30*h* along tear lines 48*h* and 49*h*, bend locking bead 40*h* away from a bottle, and remove cap 30*h* from the bottle, all in a facile manner.

With reference to FIG. 22, one will appreciate that curved portion 50*h* of tear line 48*h* extends through a plane P that is defined by a longitudinal central axis A of cap 30*h* and tear line 49*h*. As is well known, a point and a line may be used to define a plane. For example, the terminus T of tear line 49*h*, that is, the point of the tear line immediately adjacent stop 51*h* defines a point that may be used in combination with central axis A to define a specific plane P. In particular, plane P extends radially from the central axis and through terminus T. As line 23-23 of FIG. 22 extends along and within plane P, FIG. 23 is a cross-sectional view of cap 30*h* taken along plane P.

As can be seen in FIG. 22, curved portion 50*h* of tear line 48*h* extends through plane P between terminus T and longitudinal central axis A. In particular, curved portion 50*h* extends along an underside of top 31*h* at an angle with respect to plane P. Curved portion intersects plane P between central axis A and the end of straight portion 98 adjacent stop 51*h*, as is seen in FIG. 23. One will appreciate that portions 50 and 67 described above similarly extend through similarly defined planes. For example, curved portion 50 extends through the plane that is defined by the terminus of tear line 49 and the longitudinal central axis of cap 30, as is evident from FIG. 1. Arcuate portion 67 extends through the plane that is defined by the terminus of tear line 49*a* and the longitudinal central axis of cap 30*a*, as is evident from FIG. 5.

Figure 24:
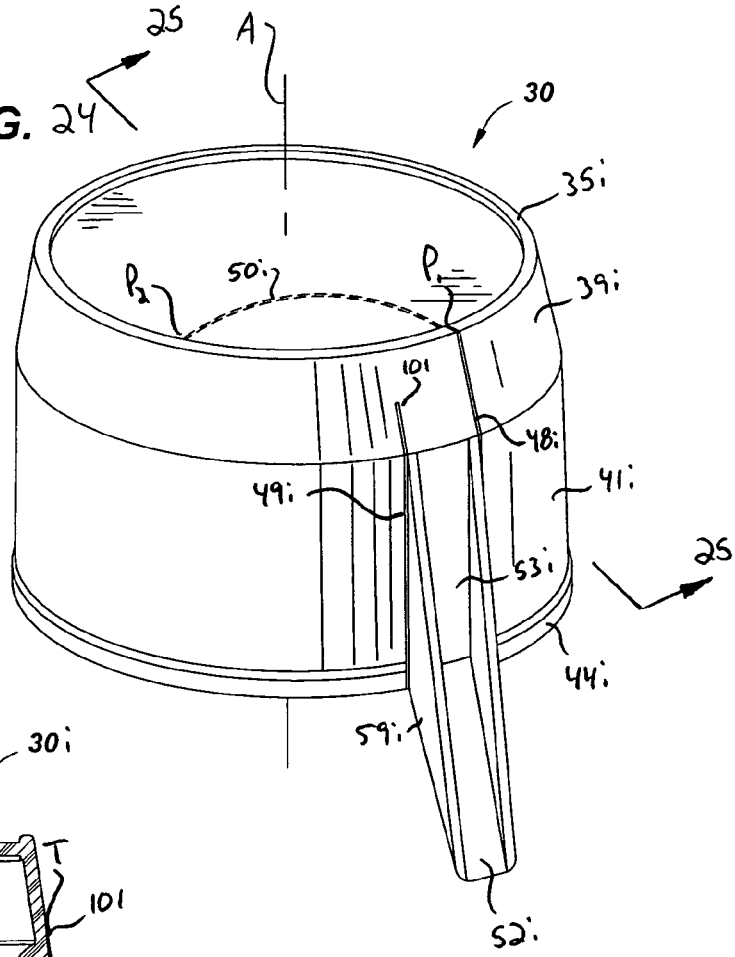
FIG. 24 is a top perspective view of a modified bottle cap similar to that shown in FIG. 1 in accordance with the present invention.
Figure 25:
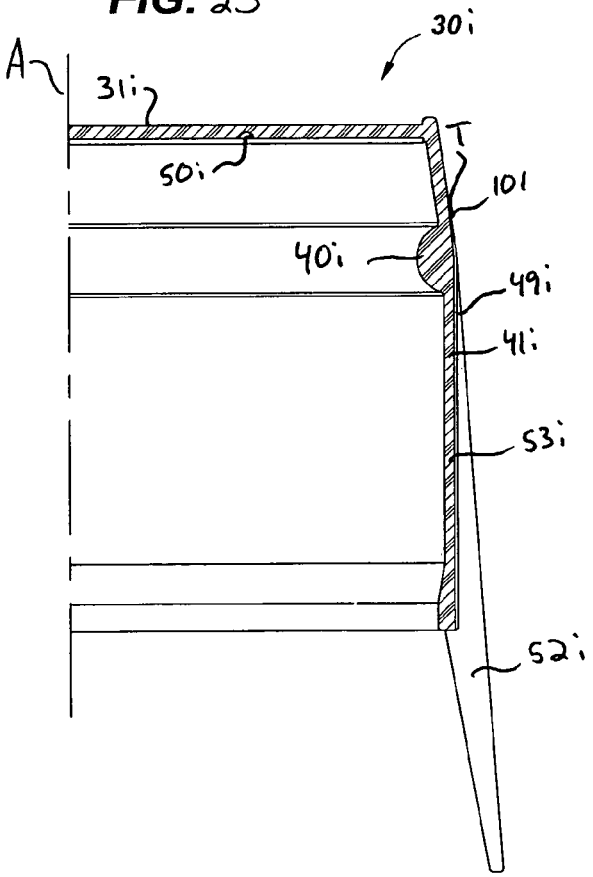
FIG. 25 is a sectional view of the cap shown in FIG. 24 taken substantially along line 25-25 of FIG. 24.

In another embodiment of the present invention shown in FIGS. 24 and 25, cap 30*i* is substantially similar to cap 30 described above except that stop 101 is positioned below periphery 35*i*. In this embodiment, tear line 49*i* terminates at stop 101 below the periphery. As is the case with the other configurations described above, stop 101 is provided to prevent splitting action along tear line 49*h* from further propagation. In this case, stop 101 is designed to inhibit and/or prevent propagation of tear line 49*i* from extending to top 31*i*. In the illustrated embodiment, stop 101 is provided in the form of a tapered end, which tapered configuration makes it increasingly more difficult for a user to continue tearing along tear line 49*i* as splitting action approaches the terminus thereof. One will appreciate, however, that stop 101 may have other suitable shapes and configurations.

In use and operation, removing cap 30*i* from a bottle is similar to that of the above caps. In particular, a user may grip tab 52*i* and pull the tab to split cap 30*i* along tear lines 48*i* and 49*i*, bend locking bead 40*i* away from a bottle, and remove cap 30*i* from the bottle, all in a facile manner.

In many respects the modifications of the various figures resemble those of preceding modifications and the same reference numerals followed by subscripts a, b, c, d, e, f, g, h and i designate corresponding parts.

For convenience in explanation and accurate definition in the appended claims, the terms "up" or "upper", "down" or "lower", "inside" and "outside" are used to describe features of the present invention with reference to the positions of such features as displayed in the figures.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A bottle cap comprising:

a top and a skirt depending from said top, said skirt having a bottom edge;

a locking bead radially extending inward from an interior of said skirt intermediate said top and said bottom edge;

a tear tab extending downward from said bottom edge;

a first tear line proximate said tear tab and extending upward along said skirt from said bottom edge across said locking bead and terminating at a terminus, said first tear line being substantially parallel to a longitudinal axis of said cap wherein said first tear line and said longitudinal axis define a radially extending plane P; and a second tear line proximate said tear tab extending upward along said skirt from said bottom edge across said locking bead and spaced from said first tear line, an upper portion of said second tear line extending through said plane P and between said terminus and said longitudinal axis.

2. The bottle cap of claim 1, wherein said skirt comprises a frustoconical upper portion and a cylindrical lower portion, wherein said first tear line extends though said cylindrical lower portion and terminates on said frustoconical upper portion.

3. The bottle cap of claim 2, wherein said second tear line extends though said cylindrical lower portion, through said frustoconical upper portion and onto said top.

4. The bottle cap of claim 1, wherein said first tear line terminates on said top adjacent to a perimeter of said top.

5. The bottle cap of claim 4, wherein said terminus is a stop located radially inward from said perimeter.

6. The bottle cap of claim 1, wherein said first tear line terminates below a perimeter of said top.

7. The bottle cap of claim 6, wherein said terminus is located below said perimeter.

8. The bottle cap of claim 7, wherein said terminus is located adjacent said locking bead.

9. The bottle cap of claim 7, wherein said first tear line is a groove and said terminus is an inclined terminal end of said groove for gradually increasing resistance to tear propagation along said first tear line.

10. The bottle cap of claim 1, wherein said upper portion of said second tear line extends along said top.

11. The bottle cap of claim 10, wherein said upper portion of said second tear line extends along said top from a first point adjacent a perimeter of said top along a curved portion to a second point adjacent said perimeter spaced from said first point.

12. The bottle cap of claim 11, wherein said second point is circumferentially spaced from said first point at least approximately 30°.

13. The bottle cap of claim 12 wherein said second point is radially spaced from said first point at least approximately 45°.

14. The bottle cap of claim 1, wherein a lower portion of at least one of said first and second tear lines extends externally along said skirt.

15. The bottle cap of claim 1, wherein said upper portion of said second tear line extends internally along said top.

16. The bottle cap of claim 1, wherein said bottle cap further comprises gripping structure for facilitating gripping of said tear tab portion by a user as the tear tab portion is torn away from said skirt, said gripping structure located intermediate said bottom edge and said top, and between said first and second tear lines, wherein said gripping structure extends radially inward from an internal surface of said skirt.

17. A bottle cap comprising:

a top and a skirt depending downward from said top, said skirt having a bottom edge; a tear tab extending downward from said bottom edge;

first and second tear lines proximate said tear tab and extending upward along said skirt from said bottom edge and defining a tear tab portion between said tear lines; and gripping structure for facilitating gripping of said tear tab portion by a user as the tear tab portion is torn away from said skirt, said gripping structure located on said tear tab portion intermediate said bottom edge and said top, and between said first and second tear lines, wherein said gripping structure extends radially inward from an internal surface of said skirt and comprises a plurality of ribs and a locking bead radially extending inward from said interior surface intermediate said top and said bottom edge, wherein said gripping structure is located intermediate said bottom edge and said locking bead.

18. The bottle cap of claim 17, wherein said first tear line extends upward along said skirt from said bottom edge and terminates at a terminus adjacent to or below a perimeter of said top, said first tear line being substantially parallel to a longitudinal axis of said cap wherein said first tear line and said longitudinal axis define a radially extending plane P; and wherein said second tear is spaced from said first tear line, an upper portion of said second tear line extending through said plane P and between said terminus and said longitudinal axis.

* * * * *